US011142965B2

(12) United States Patent
Bay

(10) Patent No.: US 11,142,965 B2
(45) Date of Patent: Oct. 12, 2021

(54) SYSTEM AND METHOD FOR DEPLOYING SUBSEA AND DOWNHOLE EQUIPMENT

(71) Applicant: Aker Solutions, Inc., Houston, TX (US)

(72) Inventor: Lars Bay, Houston, TX (US)

(73) Assignee: Aker Solutions Inc., Houston, TX (US)

( * ) Notice: Subject to any disclaimer, the term of this patent is extended or adjusted under 35 U.S.C. 154(b) by 0 days.

(21) Appl. No.: 16/462,839

(22) PCT Filed: Nov. 14, 2017

(86) PCT No.: PCT/US2017/061442
§ 371 (c)(1),
(2) Date: May 21, 2019

(87) PCT Pub. No.: WO2018/097986
PCT Pub. Date: May 31, 2018

(65) Prior Publication Data

US 2019/0301252 A1 Oct. 3, 2019

Related U.S. Application Data

(60) Provisional application No. 62/425,942, filed on Nov. 23, 2016.

(30) Foreign Application Priority Data

Mar. 3, 2017 (NO) ..... 20170316

(51) Int. Cl.
*E21B 15/02* (2006.01)
*E21B 19/10* (2006.01)
(Continued)

(52) U.S. Cl.
CPC ..... *E21B 19/002* (2013.01); *B63B 27/08* (2013.01); *B63B 27/10* (2013.01); *B66D 1/60* (2013.01);
(Continued)

(58) Field of Classification Search
None
See application file for complete search history.

(56) References Cited

U.S. PATENT DOCUMENTS 4,401,398 A * 8/1983 Remson ..... E21B 7/136 166/367
6,612,369 B1 * 9/2003 Rocha ..... E21B 19/002 166/363
(Continued)

FOREIGN PATENT DOCUMENTS

KR 10-1299868 B1 8/2013
WO 2016193169 A1 8/2016

OTHER PUBLICATIONS

International Search Report and Written Opinion issued in PCT/US2017/061442, dated Feb. 27, 2018; 14 pages.
(Continued)

*Primary Examiner* — Matthew Troutman
*Assistant Examiner* — Douglas S Wood
(74) *Attorney, Agent, or Firm* — Baker Botts L.L.P.

(57) ABSTRACT

A flexible deployment system is used to deploy subsea/downhole well equipment or modules from a multi-purpose vessel without requiring a moon pool and a derrick or tower. The deployment system may include the vessel and a deployment frame disposed on the vessel. The deployment frame includes a protruding section extending as a cantilever beyond an external edge of the vessel, and the protruding section includes an aperture formed therein to facilitate construction of the well equipment or modules through the protruding section. The deployment system also includes an actuation assembly coupled to the protruding section to selectively transition the protruding section to a collapsed, split, or retracted orientation out of a deployment path of the well equipment or modules. The system allows for controlled deployment of well equipment or modules including
(Continued)

at least a string of downhole tools or tubulars coupled end to end from the side of the vessel in a single trip.

21 Claims, 20 Drawing Sheets

(51) Int. Cl.

| | |
|---|---|
| ***E21B 19/24*** | (2006.01) |
| ***E21B 41/04*** | (2006.01) |
| ***E21B 19/00*** | (2006.01) |
| ***E21B 43/013*** | (2006.01) |
| ***B66D 1/60*** | (2006.01) |
| ***B63B 27/08*** | (2006.01) |
| ***B63B 27/10*** | (2006.01) |

(52) U.S. Cl.
CPC ..... *E21B 15/02* (2013.01); *E21B 19/008* (2013.01); *E21B 19/10* (2013.01); *E21B 19/24* (2013.01); *E21B 43/0135* (2013.01); *E21B 41/04* (2013.01)

(56) References Cited

U.S. PATENT DOCUMENTS

| | | | | |
|---|---|---|---|---|
| 6,901,998 | B1 | 6/2005 | Roodenburg et al. | |
| 6,932,553 | B1 | 8/2005 | Roodenburg et al. | |
| 9,896,167 | B2 * | 2/2018 | Roodenburg ..... | E21B 15/02 |
| 10,337,258 | B2 * | 7/2019 | Dowdy ..... | E02B 17/00 |
| 2002/0159840 | A1 | 10/2002 | Bennett, Jr. et al. | |
| 2007/0187108 | A1 | 8/2007 | Zheng | |
| 2013/0327534 | A1 | 12/2013 | Christie et al. | |
| 2015/0330048 | A1 | 11/2015 | Gardner | |

OTHER PUBLICATIONS

Office Action and Search Report issued in related Norwegian Application No. 20170316, dated Jul. 10, 2017, 4 pages.

Vessel Deployment System (VDS), Brochure, Well Ops Deployment System, 2 pages.

* cited by examiner

SYSTEM AND METHOD FOR DEPLOYING SUBSEA AND DOWNHOLE EQUIPMENT

CROSS REFERENCE TO RELATED APPLICATIONS

The present application is a U.S National Stage Application of International Application No. PCT/US2017/061442 filed Nov. 14, 2017, which claims priority to U.S. Provisional Patent Application No. 62/425,942, entitled "SYSTEM AND METHOD FOR DEPLOYING SUBSEA AND DOWNHOLE TOOL STRINGS", filed on Nov. 23, 2016, and; Norwegian Patent Application No. 20170316, entitled "SYSTEM AND METHOD FOR DEPLOYING SUBSEA AND DOWNHOLE TOOL STRINGS" filed on Mar. 3, 2017. All of these applications are hereby incorporated by reference in their entirety and for all purposes.

TECHNICAL FIELD

The present disclosure relates generally to subsea wells and, more particularly, to a system and method for deploying subsea and downhole tool strings into subsea wells.

BACKGROUND

Conventional methods for installing subsea modules and downhole tool strings from a floating vessel (e.g., semi-submersible rig) onto a subsea wellhead normally involve the use of a vessel specifically designed for the task. For example, the vessel used during installation generally includes a derrick positioned on the vessel and a moon pool formed in the vessel. The derrick deploys the subsea modules and downhole strings through the moon pool and lowers these components to the seabed for connection to the subsea wellhead. Unfortunately, the daily operating costs associated with the use of semi-submersible rigs with a moon pool are high, and it is now recognized that a need exists for more cost effective methods of deploying subsea and downhole equipment.

SUMMARY

In accordance with the above, presently disclosed embodiments are directed to a system for deploying well equipment to a subsea well. The system includes a vessel and a deployment frame disposed on the vessel. The deployment frame includes a protruding section extending as a cantilever beyond an external edge of the vessel. The protruding section includes an aperture formed therein to facilitate construction of the well equipment through the protruding section. The system also includes an actuation assembly coupled to the protruding section to selectively transition the protruding section to a collapsed, split, or retracted orientation out of a deployment path of the well equipment.

In addition, presently disclosed embodiments are directed to a method including constructing well equipment including at least a downhole tool string over an external edge of a vessel. The well equipment is supported over the external edge via a protruding section of a deployment frame disposed on the vessel, and the protruding section includes an aperture through which at least a portion of the well equipment is disposed. The method also includes suspending the well equipment from a deployment cable, splitting, retracting, or collapsing the protruding section of the deployment frame out of a path of the well equipment, and lowering the well equipment toward a subsea wellhead in a single trip.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
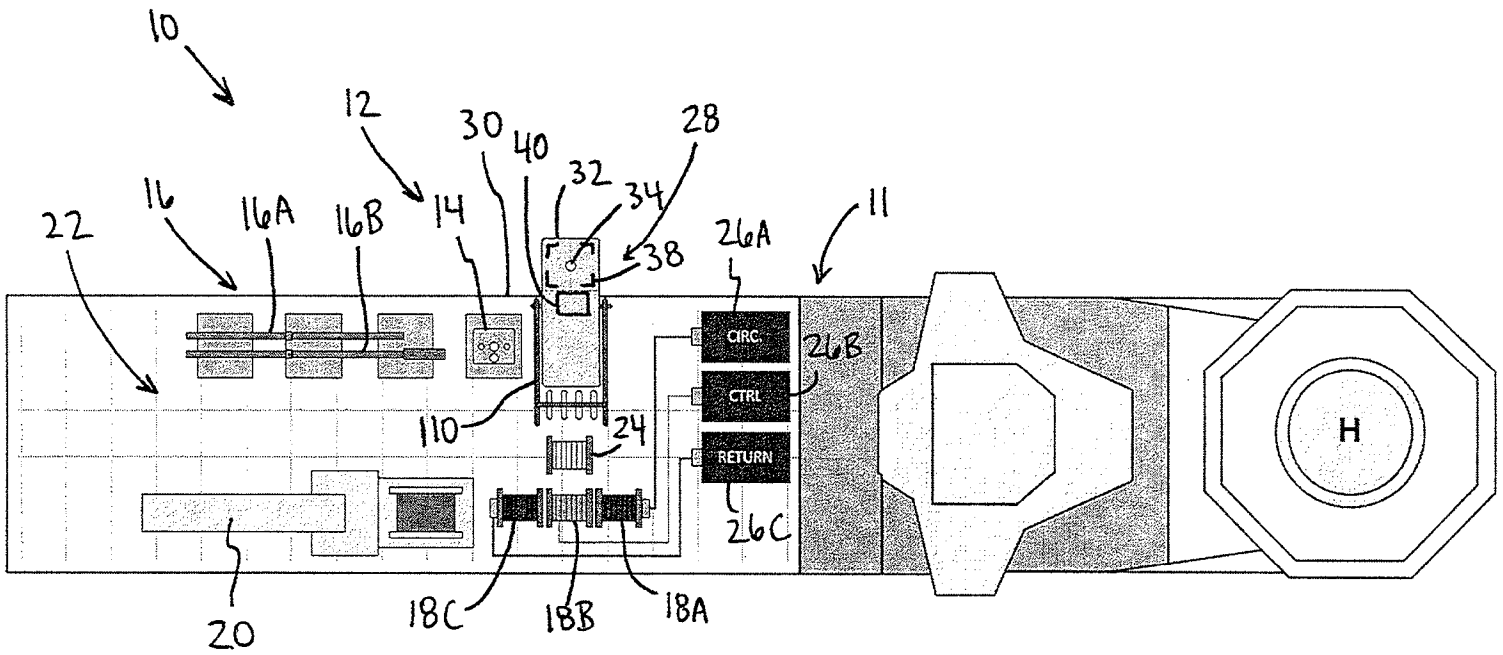
FIGS. 1 and 2 are schematic top views of a multi-purpose vessel that can be used to deploy various subsea well intervention systems, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Embodiments of the present disclosure are directed to systems and methods for deploying and retrieving subsea/downhole tubulars or tool strings alone or together with subsea modules in a single trip from a multi-purpose vessel (MPV) without a moon-pool and derrick. Conventionally, subsea modules and subsea/downhole tubulars or tool strings are deployed through a moon pool of a semi-submersible vessel equipped with a derrick or tower for lowering the equipment through the moon pool. However, there are high daily operating costs associated with the use of such semi-submersible rigs with a moon pool and derrick.

The present disclosure provides a method where a flexible deployment system is used to deploy subsea/downhole tubulars or tool strings and/or subsea modules from a MPV without requiring a moon pool and a derrick or tower. The deployment system may include the MPV and a deployment frame disposed on the vessel. The deployment frame includes a protruding section extending as a cantilever beyond an external edge of the vessel, and the protruding section includes an aperture (i.e., mouse hole aperture) formed therein to facilitate construction of the well equipment, such as a well intervention system, through the protruding section. The deployment system also includes an actuation assembly coupled to the protruding section to selectively transition the protruding section to a collapsed, split, or retracted orientation out of a deployment path of the well equipment.

The deployment system may facilitate easy construction of a well intervention system including at least a string of downhole tools connected together end to end. The well intervention system may also include a subsea module through which the downhole tool string is landed. The subsea module may be supported by the protruding section while the downhole tool string is constructed through the internal bore of the subsea module and the aperture on the protruding section. Once the well intervention system is constructed, the well intervention system may be suspended from a deployment cable on the vessel and lifted out of engagement with the protruding section. The protruding section may then be split, retracted, or collapsed out of the path of the well intervention system, and the system may be lowered toward the subsea wellhead in a single trip. In some instances, downlines may also be connected from spools located on the vessel through an extendable sheave frame and connected to the well intervention system prior to deployment of the intervention system.

The disclosed approach enables greater flexibility for an end user in terms of what type of vessel can be used to deploy tools and modules to a subsea wellhead. The end user may have a larger fleet of vessels to choose from to deploy a well intervention system, since vessels other than the conventional semi-submersibles may be used. The day rates associated with operating the disclosed MPV to deploy tools and modules will be less than those associated with the larger conventional semi-submersibles. Further, the transit times associated with moving a MPV to a desired location to perform well interventions or plug and abandonment operations are less than those associated with a moon pool and derrick equipped vessel. As such, the overall operation may be less time consuming and, therefore, more cost effective for the end user.

Turning now to the drawings, FIG. 1 illustrates a deployment system 10 including a multi-purpose vessel (MPV) 11 that may be used to deploy an intervention system 12 for use in a subsea well. The MPV 11 does not include a derrick, tower, or moon pool. The intervention system 12 includes at least a downhole tool string to be positioned inside the subsea well. The intervention system 12 may also include any desired number of subsea modules and/or a subsea tool string in addition to the downhole tool string used to perform a particular downhole (i.e., in-well) operation. The intervention system 12 may be utilized for any desired type of subsea well operations such as, for example, plug and abandonment operations, among others.

The illustrated intervention system 12 may have certain functionalities. However, it should be noted that the deployment system 10 and method of operation is not limited to deploying only the subsea/downhole equipment illustrated in the following figures. Other types, numbers, and arrangements of the illustrated components of the intervention system 12 may be deployed in other embodiments.

As shown in FIG. 1, the intervention system 12 may include a subsea module 14 and an in-well tool string 16 (broken into first and second tool string components 16A and 16B). Multiple downlines 18A-18C may be disposed around corresponding reels on the vessel 11 and hooked up to the well intervention system 12 before or after deployment of the system 12. These downlines 18A-18C may include fluid, control, or communication downlines designed to communicate various media (e.g., electrical signals, power, hydraulic fluid, air, fiber optics, etc.) to the subsea well and downhole/subsea equipment disposed in or hooked up to the well. For example, the downlines 18A and 18C may be utilized for pumping a medium into the subsea well and outer annuli to allow for circulation of the well. The downline 18B may be used for control and monitoring purposes of the subsea module 14 and/or the tool string 16.

The subsea module 14 may be designed to be installed directly onto a subsea wellhead on the seabed, on a subsea tree coupled to the subsea wellhead, or on an already installed intervention system (e.g., a riserless intervention system installed either on the wellhead or on a subsea tree coupled to the wellhead). Although only one subsea module 14 is illustrated in the intervention system 12 of FIG. 1, other numbers of subsea modules 14 may be deployed in other embodiments. In such cases, the subsea modules 14 may be connected together on top of a subsea wellhead or subsea tree. When installed, the subsea module 14 (or modules) may provide sufficient barriers towards a re-entry mandrel that it is connected to, and as such the subsea module 14 may be furnished with isolation devices to isolate the bores connected to fluid downlines (e.g., 18A and 18C).

The term in-well tool string 16 or downhole tool string may refer to a string of multiple tool components (e.g., 16A and 16B) connected end to end to and designed to perform a specific operation when disposed into a subsea wellbore. Although two tool string components 16A and 16B are illustrated in FIG. 1, other intervention systems 12 may include larger numbers of components (e.g., 3, 4, 5, 6, 7, 8, or more total) depending on the ultimate length and functionality of the tool string 16. The tool string 16, once assembled, may be suspended from the subsea module 14 into the well via a tool hanger. The tool string 16 may be furnished with one or more inflatable elements used to seal off various zones within the well. The tool string 16 may include one or more perforating guns or other components designed to allow for circulation of fluids from the internal bore of the tool string 16 into the outer annuli of the well surrounding the tool string 16. In addition, the tool string 16 may have flow paths aligned with the bores of the subsea module 14 such that fluid flow can be directed from the downline 18A, through the subsea module 14 and into the tool string 16, then back to the MPV 11 via the downline 18C.

Figure 2:
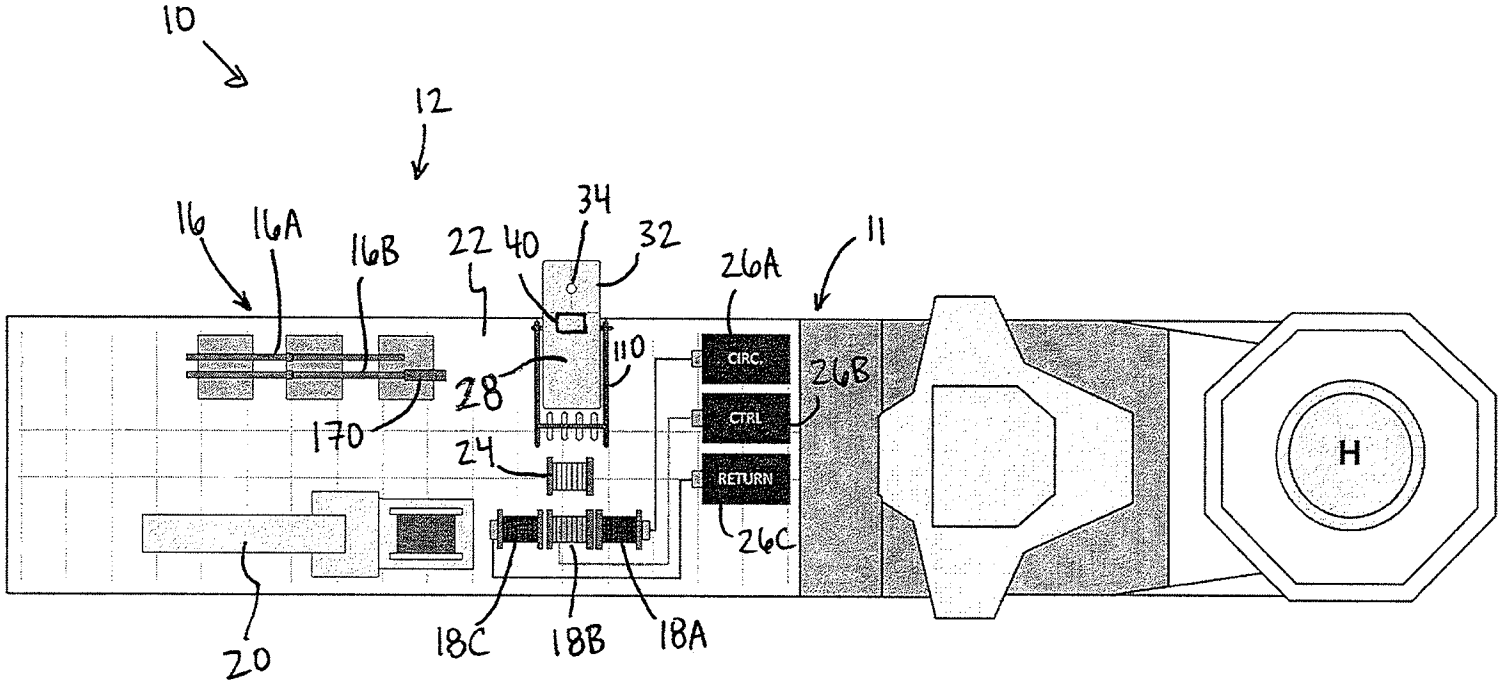

FIG. 2 illustrates another type of intervention system 12 that may be deployed using the MPV 11 and deployment equipment disposed thereon. In FIG. 2, the intervention system 12 may include the same components of the intervention system 12 of FIG. 1, except for the subsea module. That is, the intervention system 12 may include an in-well tool string 16 (broken into first and second tool string components 16A and 16B). As shown, the tool string component 16B may include a pre-installed tool hanger 170, which may be used to support the fully assembled downhole tool string 16 within the wellhead, tree, or other intervention system. Again, multiple downlines 18A-18C may be connected to the intervention system 12 of FIG. 2 before or after deployment of the intervention system 12. As described above, these downlines 18A-18C may include fluid, control, or communication downlines designed to communicate various media (e.g., electrical signals, power, hydraulic fluid, air, etc.) to the subsea well and the tool string disposed in the well.

The in-well tool string 16 or downhole tool string may be a string of multiple tool components (e.g., 16A and 16B) connected end to end to and designed to perform a specific operation when disposed into a subsea wellbore. Although two tool string components 16A and 16B are illustrated, other intervention systems 12 may include larger numbers of components (e.g., 3, 4, 5, 6, 7, 8, or more total) depending on the ultimate length of the tool string 16. The tool string 16, once assembled, may be lowered into the well and seated in the well via a tool hanger. The tool string 16 may be furnished with one or more inflatable elements used to seal off various zones within the well. The tool string 16 may include one or more perforating guns or other components designed to allow for circulation of fluids. In addition, the tool string 16 may have flow paths that can be connected to various downlines 18A-18C extending from the vessel 11.

Figure 22:
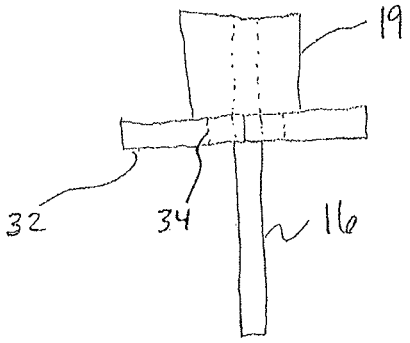
FIG. 22 is a schematic illustration of a system that may be deployed using the multi-purpose vessel of FIGS. 1 and 2, in accordance with an embodiment of the present disclosure.

FIG. 22 provides a more generalized illustration of a well system 12 that may be deployed using the deployment system. Specifically, the well system 12 may include the downhole tool string 16 (constructed from multiple tool components coupled together end to end) and a coupling 19 disposed at an upper end of the tool string 16. The coupling 19 is designed to support the tool string 16 and interface directly with the subsea wellhead, subsea tree, spool, or other intervention system into which the tool string 16 is deployed. The coupling 19 may be a tool hanger (e.g., 170 of FIG. 2), a tubing hanger, a cap, a subsea module (e.g., 14 of FIG. 1), or any other type of interface component for supporting the downhole tool string 16 within a subsea component. The coupling 19 may be pre-installed on a tool component of the downhole tool string 16, such as is the case with the tool hanger 170 on the tool component 16B of the well system 12 in FIG. 2. In other instances, the coupling 19 may be initially provided as a separate component from the downhole tool string 16, such as the subsea module 14 of FIG. 1. When the coupling 19 is a separate component from the tool string 16, the coupling 19 may have a bore formed therethrough (e.g., bore 36 of FIG. 1) that is designed to receive and interface with the tool string 16. The following description regarding deploying a well system 12 using the disclosed system may be applied to a well system 12 having any type or arrangement of downhole tool string 16 and associated coupling 19.

The disclosed MPV 11 may be used to deploy any of the well systems 12 of FIGS. 1, 2, and 22. FIGS. 1 and 2 show the topside spread of the MPV 11 before a deployment operation begins. The MPV 11 may be equipped with a standard vessel crane 20 and available deck space 22 to lay out the other deployment system equipment described herein. The deck 22 may be furnished with a skidding system that can be used to move heavy equipment around the deck 22 without having to lift the equipment. The spread on the MPV 11 may include the well intervention system 12 broken into two (or more) parts (e.g., 16A, 16B, and/or 14), a deployment cable reel 24, and multiple downlines 18A-18C disposed around reels connected to suitable tanks, pumps, control systems, or other equipment (26A-26C). For example, in the illustrated embodiment, the spread may include a circulating pump 26A coupled to the downline 18A, a control system 26B coupled to the downline 18B, and a return fluid tank 26C coupled to the downline 18C.

Further, the spread on the MPV 11 includes a deployment frame 28. The deployment frame 28 may be connected to the skidding system on the deck 22, thereby allowing the deployment frame 28 to be selectively extended over a side 30 of the vessel 11. The deployment frame 28 may similarly be retracted back into a position fully supported by the deck 22 (i.e., not extending over the side 30 of the vessel 11 as shown) using the skidding system on the deck 22. When in the extended mode, the deployment frame 28 includes a protruding section 32 extending out over the edge or side 30 of the vessel 11. In this position, the protruding section 32 is cantilevered over the edge 30 of the vessel 11. In the extended mode, the protruding section 32 of the deployment frame 28 may be large enough to fit the subsea module 14 of FIG. 1 thereon with a sufficient clearance from the side 30 of the vessel 11.

As shown, the protruding section 32 may be equipped with a mouse hole aperture (or "mouse hole") 34 formed therethrough. The mouse hole 34 may have an internal diameter that is approximately equivalent to the internal diameter of a vertical bore 36 through the subsea module 14. In addition, the mouse hole 34 may have an internal diameter that is larger than an outer diameter of the tool string 16 so that the tool string 16 may be lowered through the mouse hole 34. The mouse hole 34 may be used when constructing the tool string 16 either alone or within the subsea module 14 disposed on the protruding section 32. The mouse hole 34 may enable construction of long tool strings 16 (which would otherwise require the use of a derrick/tower and moon pool) using the MPV 11.

As described in greater detail below, the protruding section 32 is selectively movable between an extended position (as shown in FIG. 1) where the protruding section 32 is disposed beneath and supporting a section of the intervention system 12 and a collapsed, retracted, or split orientation where the protruding section 32 is not disposed beneath the section of the intervention system. When in this collapsed, retracted, or split position, the protruding section 32 is effectively removed from a deployment path of the intervention system 12 to enable the intervention system 12 to be lowered toward a subsea wellhead.

As shown in FIG. 1, the protruding section 32 may include a suitable guiding system designed to allow controllable landing of the subsea module 14 onto the protruding section 32 when the module 14 is lifted by the crane 20. For example, the protruding section 32 may include one or more guide features 38 disposed thereon and designed to interface directly with complementary guide features (not shown) on the bottom of the subsea module 14. Such guide features 38 may include vertically extending corner seats on the protruding section 32 designed to interface with corresponding corners of the subsea module 14 and direct the subsea module 14 down onto the protruding section 32 in a position where the bore 36 of the module 14 is aligned with the mouse hole 34.

Figure 3:
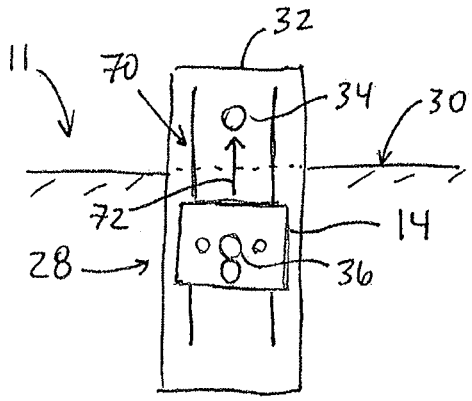
FIG. 3 is a schematic top view of a deployment frame equipped with a skidding system, in accordance with an embodiment of the present disclosure.

In FIG. 3, an example of a deck spread including a dedicated skidding system 70 on the deployment frame 28 is illustrated. As shown, the subsea module 14 may be initially parked on a portion of the deployment frame 28 that is disposed on the deck 22 and therefore not extending over the edge 30 of the vessel 11. The skidding system 70 may move the subsea module 14 from the initial position to a position on the protruding section 32 of the deployment frame 28, as indicated by arrow 72. In this position, the bore 36 of the subsea module 14 may be aligned with the mouse hole 34 through the protruding section 32.

Figure 4:
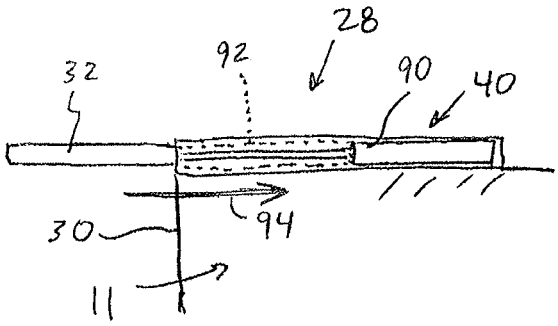
FIG. 4 is a schematic illustration of a deployment frame with a retractable protruding section, in accordance with an embodiment of the present disclosure.
Figure 5A:
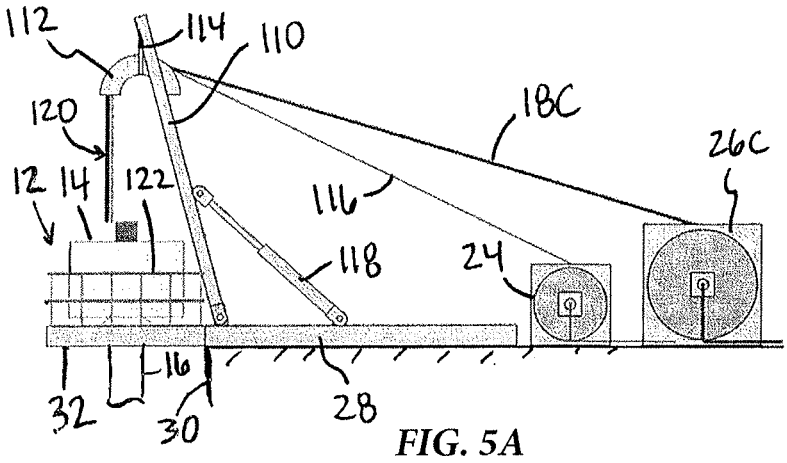
FIGS. 5A, 5B, 5C are schematic side, front, and top views of a sheave frame and deployment frame used on the multi-purpose vessel of FIGS. 1 and 2, in accordance with an embodiment of the present disclosure.
Figure 5B:
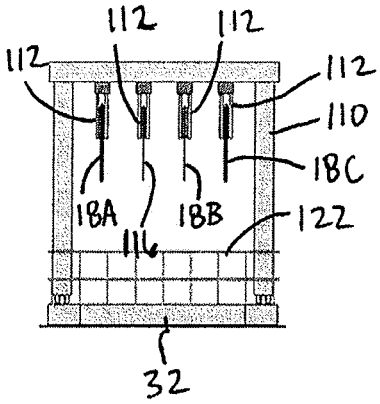
Figure 5C:
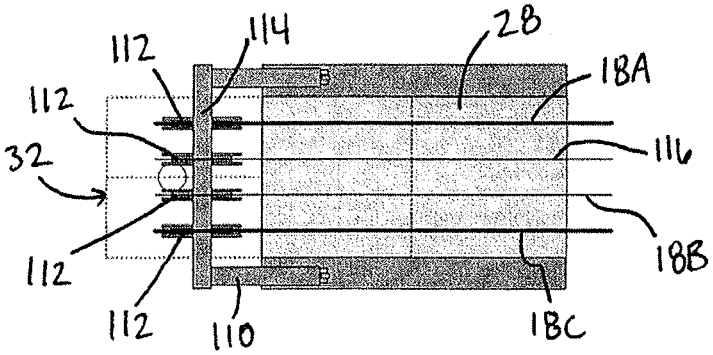
Figure 6:
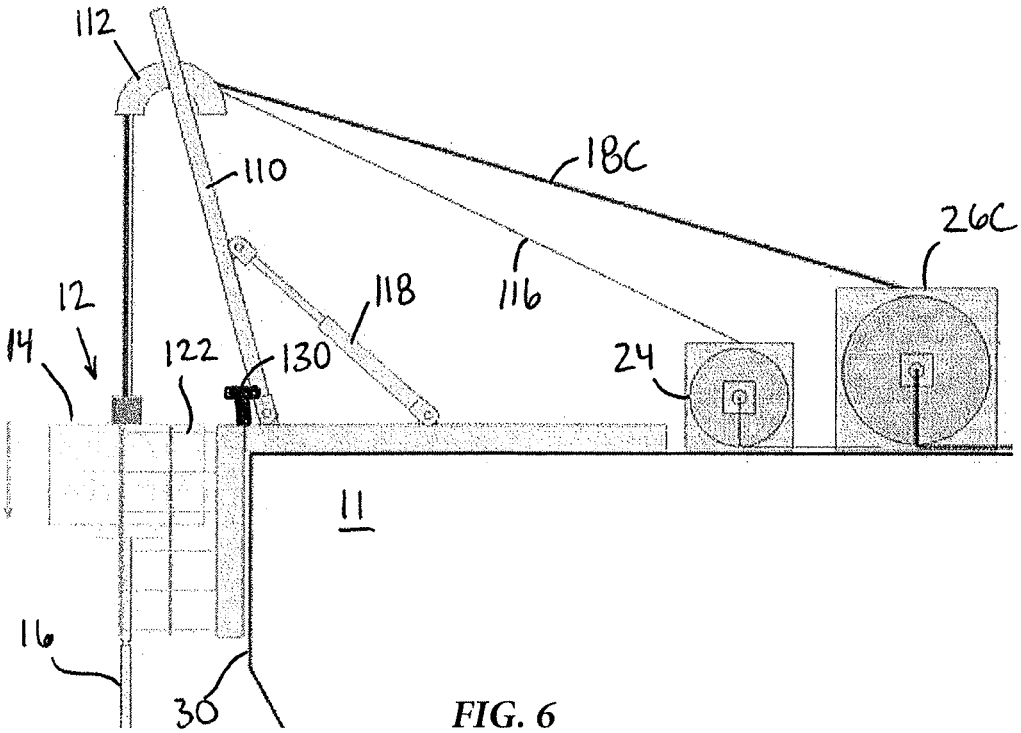
FIG. 6 is a schematic side view of a sheave frame and a deployment frame used on the multi-purpose vessel of FIG. 1 with the deployment frame in a collapsed position, in accordance with an embodiment of the present disclosure.
Figure 18:
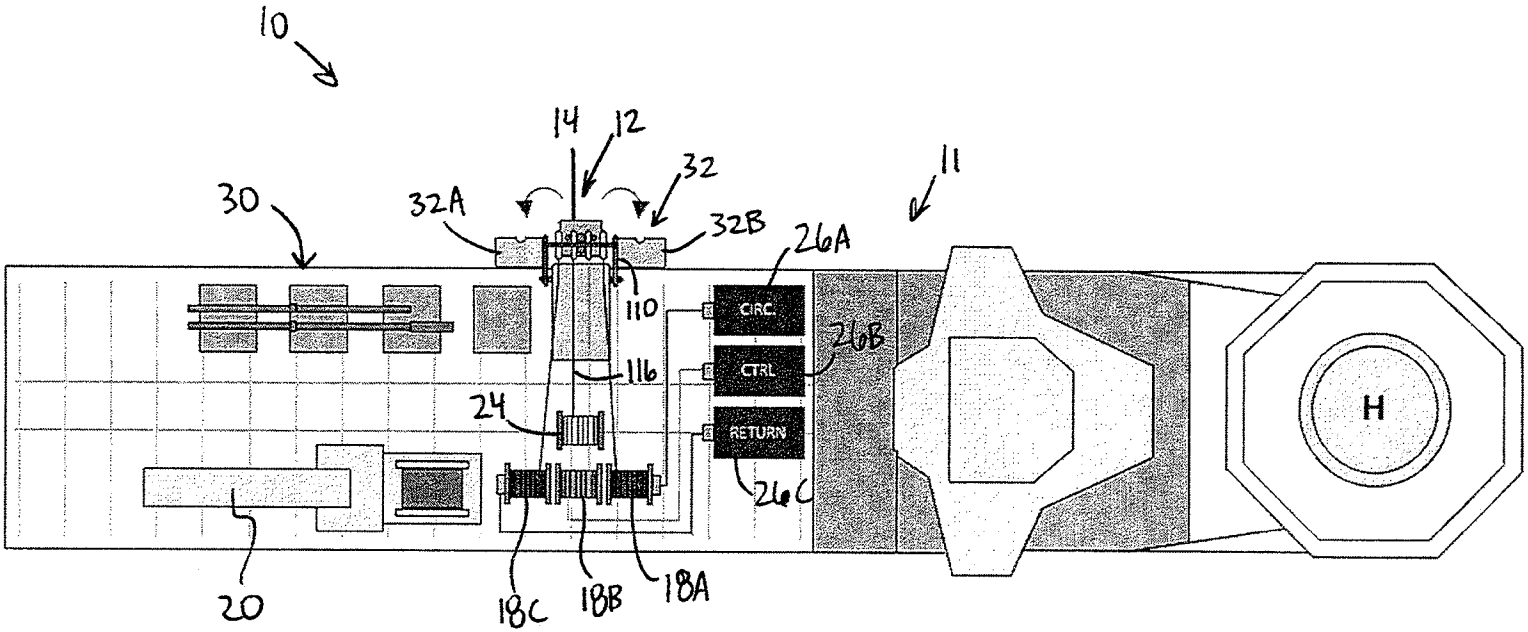
FIG. 18 is a schematic top view of the multi-purpose vessel of FIG. 1 with a deployment frame split in half, in accordance with an embodiment of the present disclosure.
Figure 23:
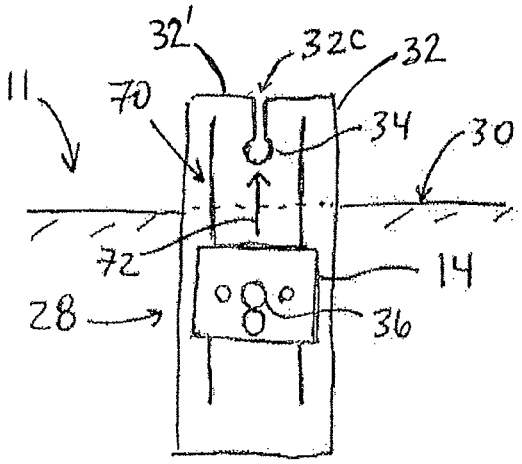
FIG. 23 is a schematic top view of a deployment frame with a protruding section having a slot, in accordance with an embodiment of the present disclosure.

Turning back to FIGS. 1 and 2, the deployment system may also include an actuation assembly (represented schematically by reference numeral 40 on the deployment frame 28 that, when activated, removes the protruding section 32 from the location directly underneath the tool string 16 and/or the subsea module 14. This may allow the tool string 16 (with or without the subsea module 14 to be deployed over the side 30 of the vessel 11. In some embodiments, the actuation assembly 40 may include one or more latching mechanisms that hold the protruding section 32 in position beneath the subsea module 14 and/or tool string 16 until they are activated. When the latching mechanisms are activated, for example, two halves 32A and 32B of the protruding section 32 may be separated to the sides and aligned with the side 30 of the vessel 11 (as shown in FIG. 18, for example). In other instances, the latching mechanisms, upon activation, may allow the protruding section 32 to collapse upwards or downwards (as shown in FIG. 6, for example). As shown in FIG. 4, the actuation assembly 40 may be an electric or hydraulic actuation assembly such as a hydraulic piston 90 that retracts the protruding section 32 into a hollow portion 92 of the deployment frame 28 adjacent the protruding section 32, as indicated by arrow 94. In other embodiments, the actuation assembly 40 may merely be the skidding system on the deck 22 used to selectively retract the protruding section 32 of the deployment frame 28 back onto the deck 22 of the vessel 11. In one embodiment, illustrated in FIG. 23, the protruding section 32 has a slot 32C extending from the aperture 34 to an external edge 32' of the protruding section 32. This may allow the protruding section 32 to collapse upwards or downwards, or be retracted backwards, with a tubular or a tool string is suspended through the aperture 34. The deployment system 10 in the topside spread of FIGS. 1 and 2 may also include a sheave frame 110 used to direct a deployment cable and various downlines (e.g. 18A-18C) into a position for connection to and deployment with the tool string 16 and/or the subsea module 14. FIGS. 5A-5C illustrate the sheave frame 110 in more detail. Although shown with a subsea module 14 and downhole tool string 16 disposed on the protruding section 32 in FIG. 5A, the same sheave frame 110 may be utilized with an intervention system 12 that does not include the subsea module 14 but instead only features a downhole tool string 16.

The sheave frame 110 may be mechanically connected to or integrated into the deployment frame 28, or the sheave frame 110 may be an entirely separate system that is installed separately from the deployment frame 28. One or more sheaves 112 may be connected to a crossbeam 114 of the sheave frame 110, as shown in FIGS. 5A-5C. The number of sheaves 112 on the crossbeam 114 may correspond directly to the number of downlines 18 to be deployed. One of the sheaves 112 on the sheave frame 110 may correspond to a deployment cable 116 from the deployment cable reel 24 used to lower the intervention system 12 toward the wellhead.

The sheave frame 110 may be extendable between a retracted position and an extended position located over the protruding section 32. FIG. 5A shows the sheave frame 110 in this extended position. In the retracted position (shown in FIG. 1), the sheave frame 110 may be lowered to a position against the deck of the vessel or the deployment frame 28, or at least to a position low enough to enable simple routing of the downlines 18 and/or deployment cable 116 through the sheaves 112. A hydraulic actuator 118 or other type of actuator may automatically move the sheave frame 110 from the retracted position to the extended position. When the sheave frame 110 is in the fully extended position, as shown, the exit points of the sheaves 112 may be aligned with termination points on the subsea module 14 and/or tool string 16 that are supported by the protruding section 32. That way the ends 120 of the cable 116 and/or downlines 18 routed from their respective reels and through the sheaves 112 may be connected to the intervention system 12 at positions that keep the cable/downlines substantially vertical and untangled during deployment. The sheave frame 110 may be furnished with a compensated deployment winch (i.e., deployment cable reel) 24 to allow for safe descent and landing of the complete intervention system 12 during deployment and subsea equipment installation.

As illustrated, the protruding section 32 of the deployment frame 28 may be equipped with a suitable support structure 122, such as a cage or fence, disposed around one or more external edges of the protruding section 32. This support structure 122 may serve multiple functions. For example, when the protruding section 32 is disposed in the horizontal position of FIG. 5A, the support structure 122 may facilitate a safe working environment for operators who are standing on the protruding section 32 to make connections between various components of the intervention system 12, the deployment cable 116, and/or the downlines 18.

In addition, the support structure 122 may be utilized to guide the intervention system 12 downward as it is lowered via the deployment cable 116 over the external edge 30 of the vessel 11. This is illustrated in detail in FIG. 6, which shows the protruding section 32 of the deployment frame 28 collapsed vertically downward. The protruding section 32 may be hinged to an adjacent portion of the deployment frame 28 and held in the horizontal position of FIG. 5A via a latching mechanism 130. Upon removal of the latching mechanism 130, however, the protruding section 32 may collapse downward as shown in FIG. 6 to an approximately vertical position against the side 30 of the vessel 11. In this position, the support structure 122 around the edges of the protruding section 32 may guide the subsea module 14 as the deployment cable 116 lowers the intervention system 12 downward proximate the side 30 of the vessel 11. The support structure 122 may minimize sideways motion of the subsea module 14 so that the module 14 does not impact the side 30 of the vessel 11.

It should be noted that in embodiments where the protruding section 32 of the deployment frame 28 is designed to collapse downwards (as shown in FIG. 6, for example) or to retract away from the intervention system 12 (as shown in FIG. 4), the protruding section 32 may include a path for the tool string 16 to escape through when the protruding section 32 folds down (or is retracted). For example, the protruding section 32 may have an opening extending from the mouse hole 34 outwards to an end of the protruding section. An obstructing member may be placed across the opening while the tool string 16 is being built through the mouse hole 34 to keep the tool string 16 in the mouse hole 34, and the obstructing member may be removed to expose the opening before the downwards (or retracting) motion of the protruding section 32 begins. That way, the tool string 16 does not get in the way of and prevent the protruding section 32 from collapsing.

Having described the general structure of the disclosed deployment system 10, a more detailed description of a method for operating the deployment system 10 will now be provided. It should be noted that the deployment method is not limited to the exact sequence described below. In addition, the order in which functions are performed in the deployment method is not limited to the order of the sequence described below.

First, the deployment method may include constructing the well intervention system 12 over the edge 30 of the vessel 11 while supporting the intervention system 12 on the protruding section 32 of the deployment frame 28. FIGS. 7-12 illustrated this construction for an intervention system 12 that includes a downhole tool string 16 and a subsea module 14. During construction of the intervention system 12, the vessel 11 and components of the deployment system 10 may be generally laid out as shown in FIG. 1. Specifically, the deployment frame 28 is in the extended mode, and the sheave frame 110 is in the retracted mode. The deployment cable reel 24 and downline reels are positioned on the deck 22 behind the deployment frame 28 such that the exit points on the reels are aligned with respective sheaves on the sheave frame 110.

Figure 7:
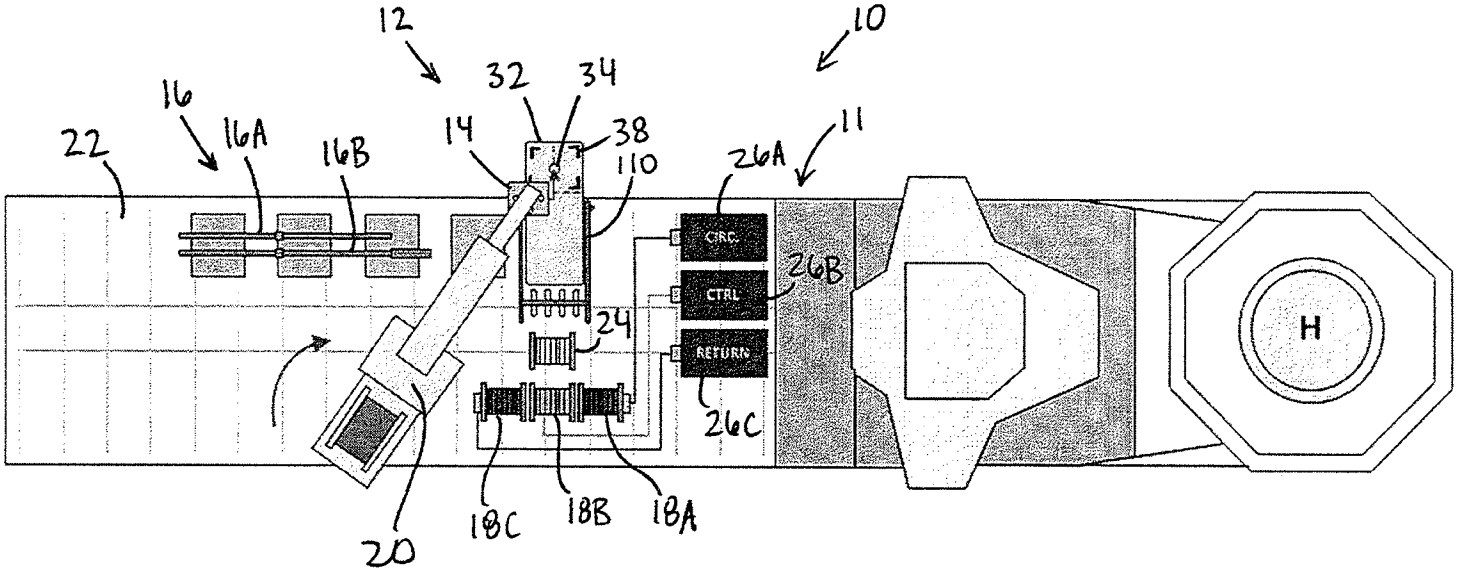
FIGS. 7, 8, 9, 10, 11, 12 are schematic top and side cutaway views of the multi-purpose vessel of FIG. 1 using a crane to assemble the intervention system, in accordance with an embodiment of the present disclosure.
Figure 8:
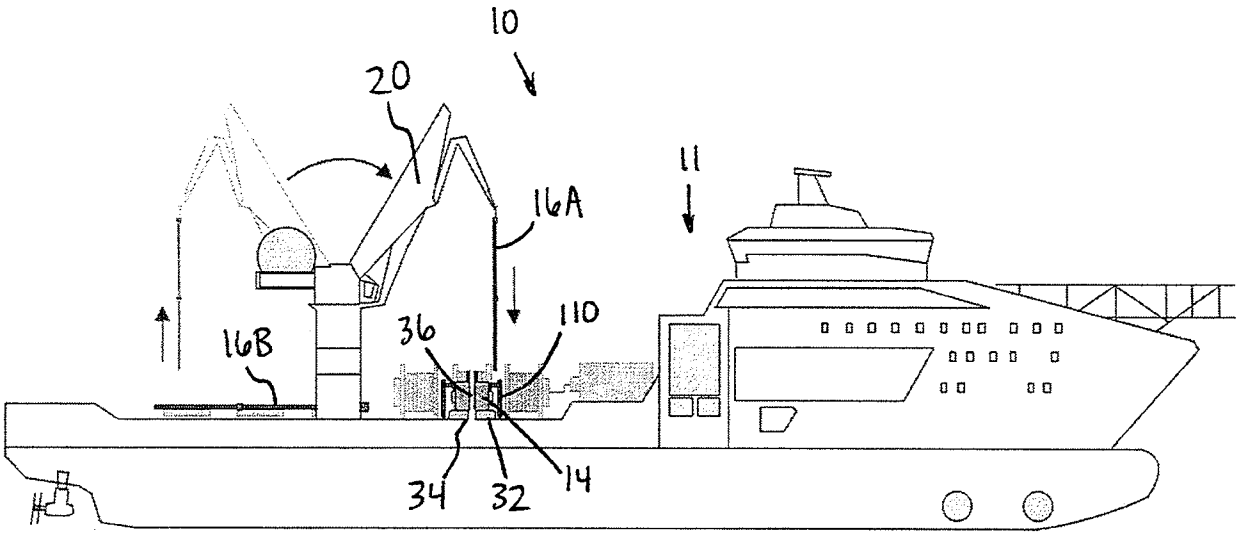
Figure 9:
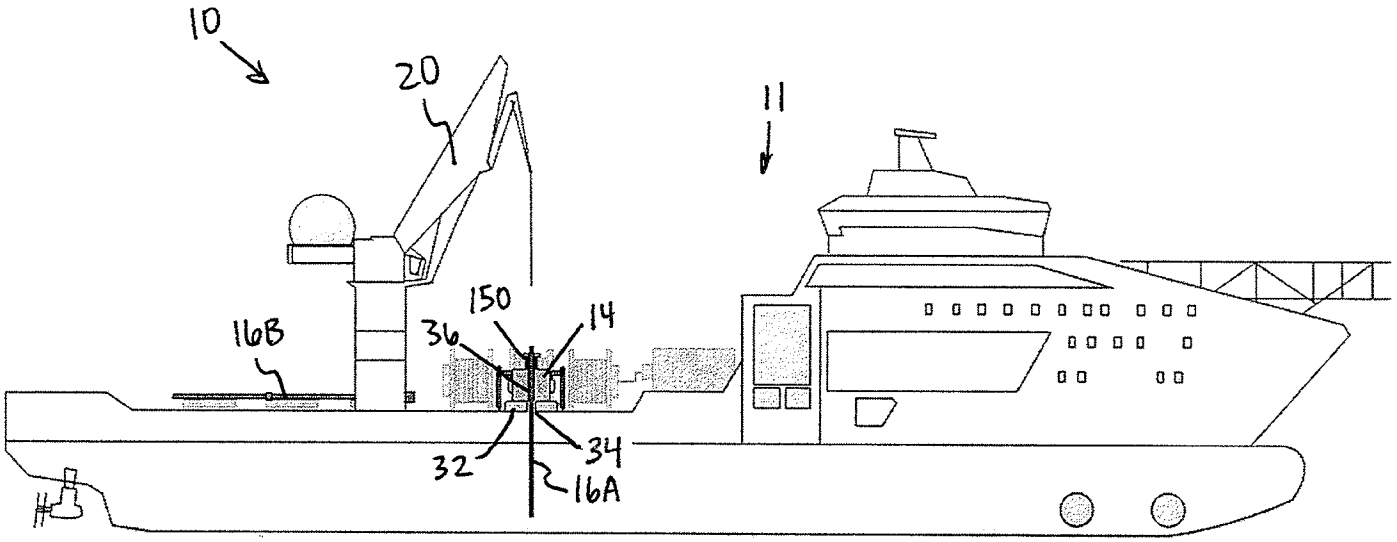

Construction of the intervention system 12 may first involve extending the protruding section 32 of the deployment frame 28 and disposing the subsea module 14 on the protruding section 32. As shown in FIG. 7, the crane 20 on the vessel 11 may lift the subsea module 14 from a position parked on the deck 22 and position the subsea module 14 on the protruding section 32 such that the internal bore 36 of the subsea module 14 is aligned with the mouse hole 34. In systems where the subsea module 14 is initially positioned on a deployment frame 28 equipped with a skidding system (e.g., 70 of FIG. 3), the skidding system 70 may be used to bring the subsea module 14 onto the protruding section 32 such that the internal bore 36 of the module 14 is aligned with the mouse hole 34. A guiding system (e.g., guide features 38 interfacing with the subsea module 14 may help with the exact positioning of the module 14 relative to the mouse hole 34. FIG. 8 illustrates the subsea module 14 landed on the protruding section 32 with its bore 36 fully aligned with the mouse hole 34.

Construction of the intervention system 12 may then involve constructing the tool string 16 through the internal bore 36 of the subsea module 14 and mouse hole 34 by connecting the multiple tubular components 16A and 16B end to end. This process is illustrated in FIGS. 8-11. First, a lower section 16A of the tool string 16 may be picked up by the vessel crane 20 and lifted above the subsea module 14, as shown in FIG. 8. The lower section 16A of the tool string 16 may then be lowered into the bore 36 of the subsea module 14. The mouse hole 34 allows the tool string 16 to pass through the subsea module 14 and the deployment frame 28. Before the lower section 16A of the tool string 16 is completely disposed inside the subsea module 14, a hang-off plate 150 (or C-plate) may be installed on the re-entry mandrel or hub of the subsea module 14. This hang-off plate 150 allows the lower section 16A of the tool string 16 to be hung from the subsea module 14 in an intermediate position (shown in FIG. 9) before the rest of the tool string 16 is connected.

Figure 10:
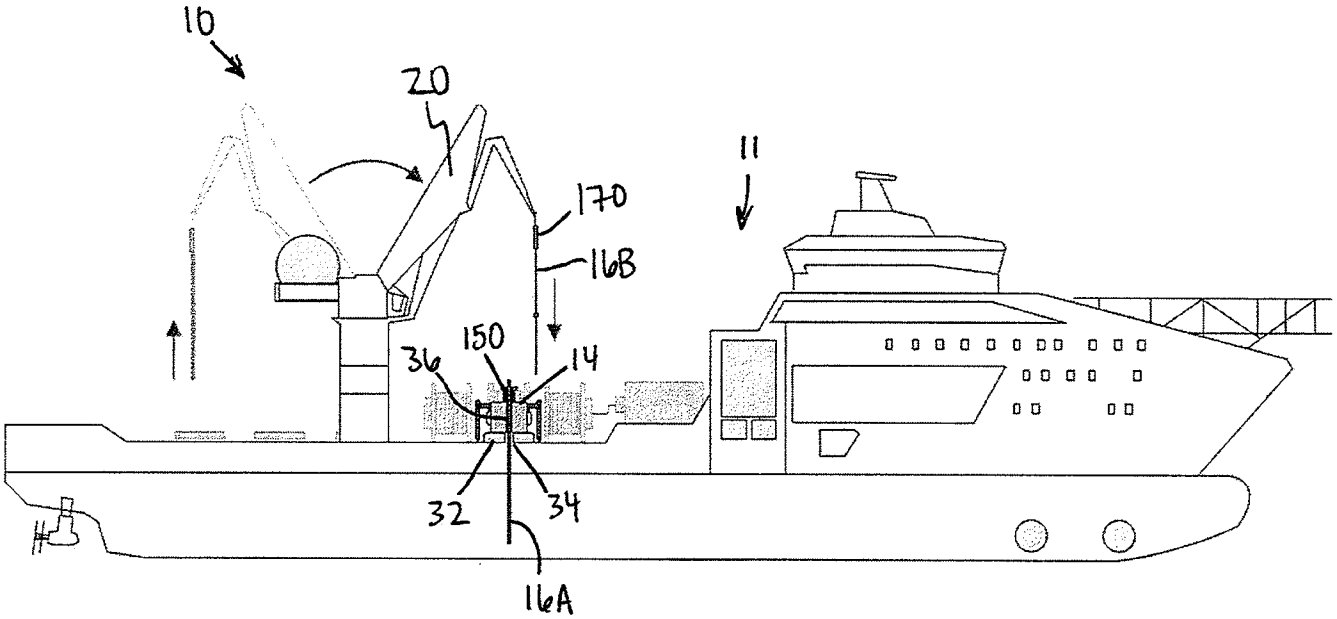
Figure 11:
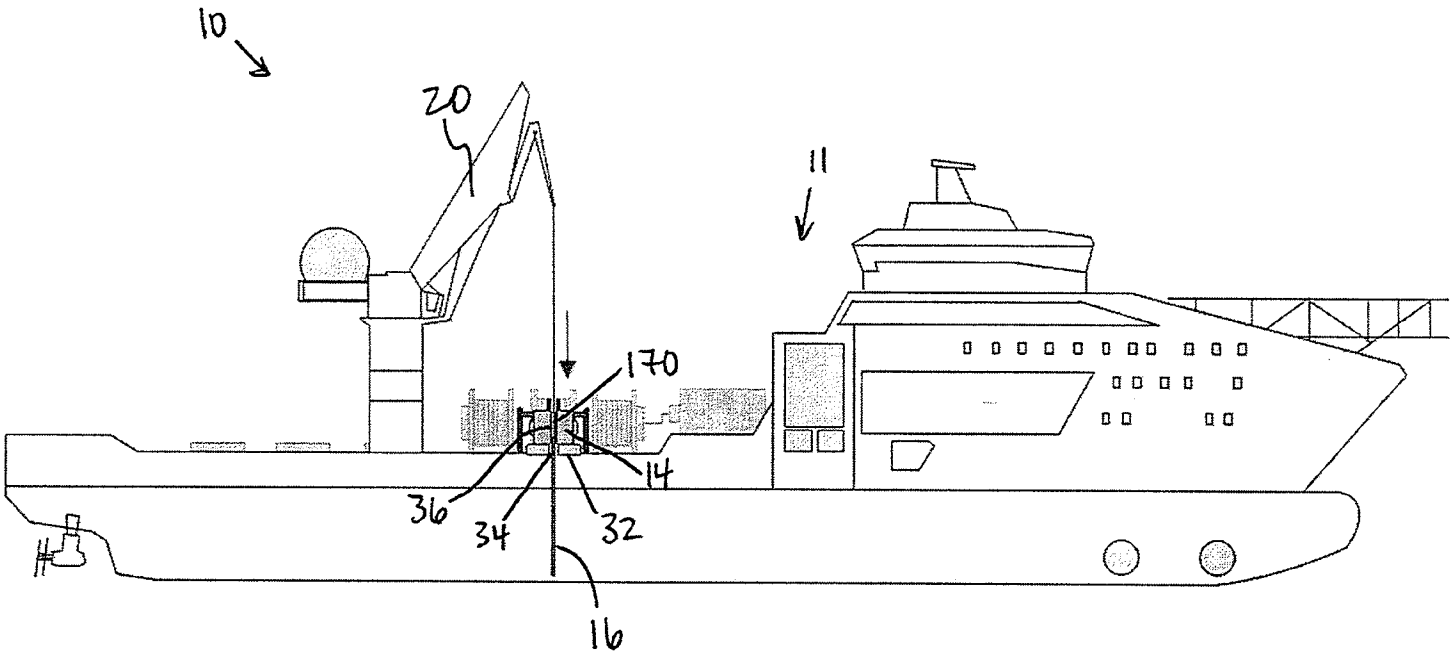

As shown in FIG. 10, an upper section 16B of the tool string 16 may than be picked up using the vessel crane 20 and lifted above the subsea module 14, while the lower section 16A is held stationary by the hang-off plate 150. The upper section 16B of the tool string 16 may be furnished with a tool hanger 170 that can be landed and locked inside the bore 36 of the subsea module 14. The vessel crane 20 may position the upper section 16B of the tool string directly above the lower section 16A such that a bottom end of the upper section 16B is touching a top end of the lower section 16A. The upper and lower sections 16B and 16A may be made up utilizing suitable tooling equipment while the vessel crane 20 (and possibly tugger wires on the vessel 11) holds the upper section 16B in place. The assembled tool string 16 may be lifted slightly to remove loads from the hang-off plate 150 before the plate 150 is removed. Once the hang-off plate 150 is removed, the tool string 16 may be supported entirely by the vessel crane 20. From here, the connected tool string 16 may be lowered into the subsea module 14.

It should be noted that although the illustrated tool string 16 includes only two sections 16A and 16B, other tool strings may include three or more separate tubular components that are connected together through the mouse hole 34 of the protruding section 32. In such instances, after two sections are connected, the partially constructed tool string may be lowered through the subsea module 14 and the hang-off plate 150 may be positioned around the top section of the partially constructed tool string to support the weight of the string before the next tubular component can be added using the crane 20. The steps illustrated in FIGS. 9-11 may be repeated multiple times until the tool string 16 is fully assembled.

Figure 12:
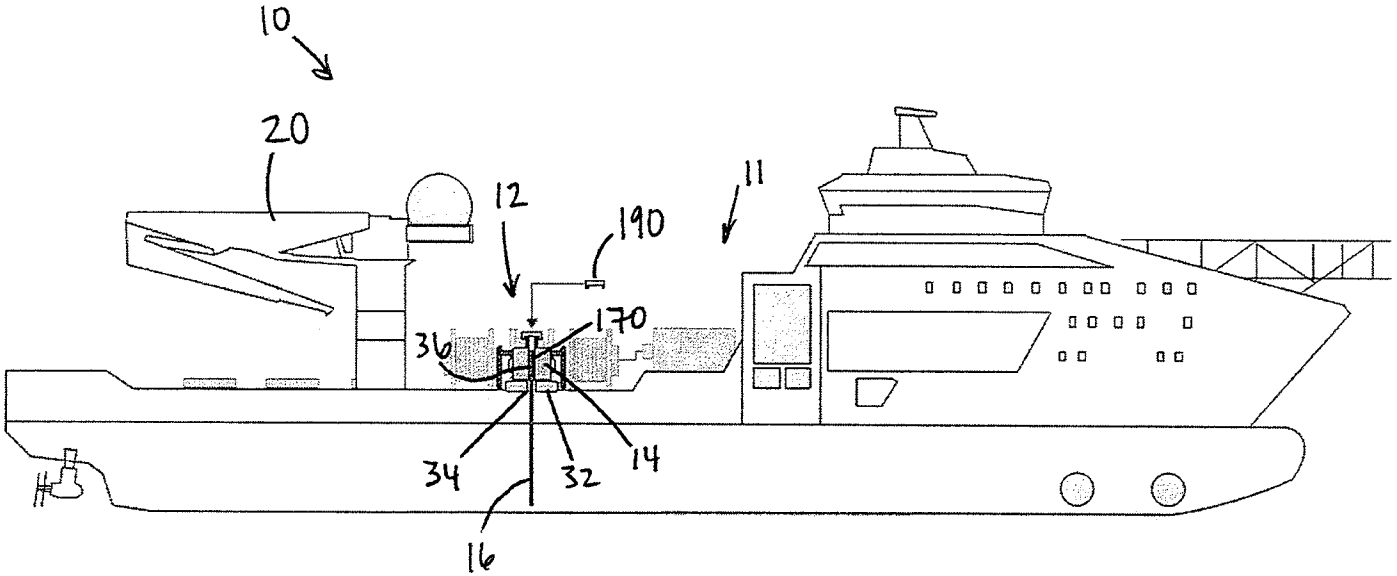

Once fully constructed, the tool string 16 may be lowered via the crane 20 into the subsea module 14. The tool hanger 170 mounted to the upper section 16B of the tool string 16 may interface with a guiding system used to orient the tool string 16 properly inside the subsea module 14. The guiding system may be located internally to the subsea module 14 (e.g., inside the spool wall of the subsea module 14) or may be a separate device located externally to the subsea module 14. The guiding system may be used to align the tool string 16 with applicable interfaces on the subsea module 14. Such interfaces may include, for example, control and monitoring line interfaces and/or bore alignment interfaces across the tool hanger 170 and the spool wall of the subsea module 14. When the tool string 16 is appropriately connected inside the subsea module 14, a deployment tool 190 may be installed on the re-entry hub of the subsea module 14, as shown in FIG. 12.

Figure 13:
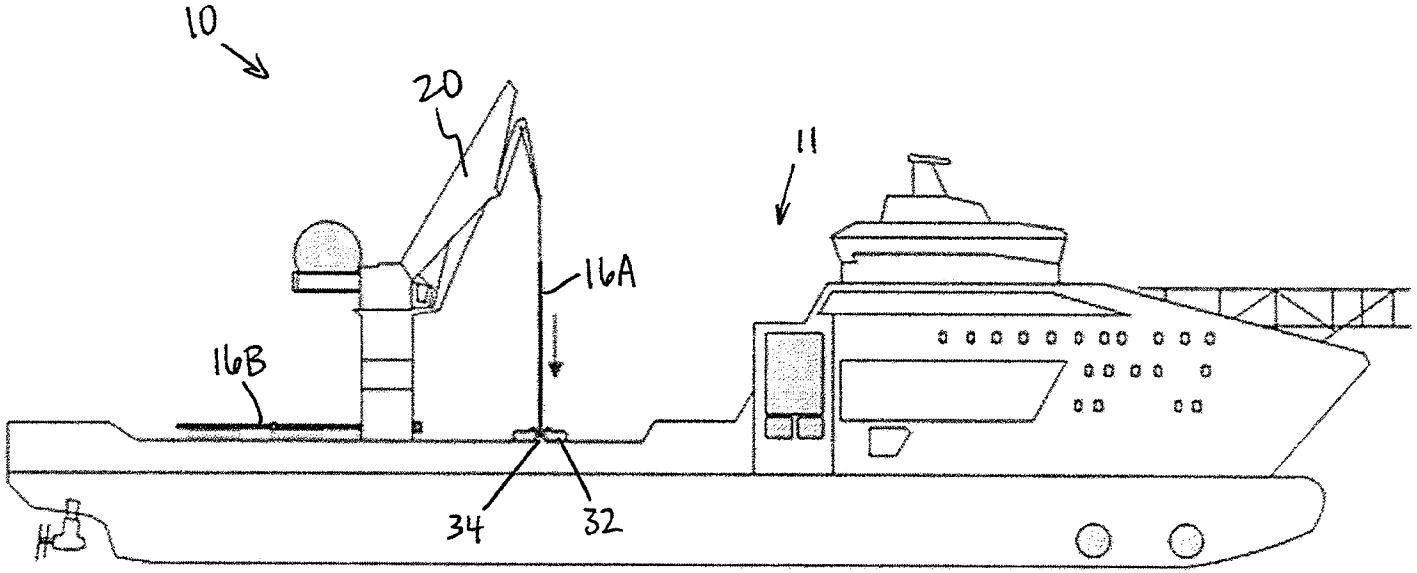
FIGS. 13 and 14 are schematic side cutaway views of the multi-purpose vessel of FIG. 2 being used to assemble the intervention system, in accordance with an embodiment of the present disclosure.
Figure 14:
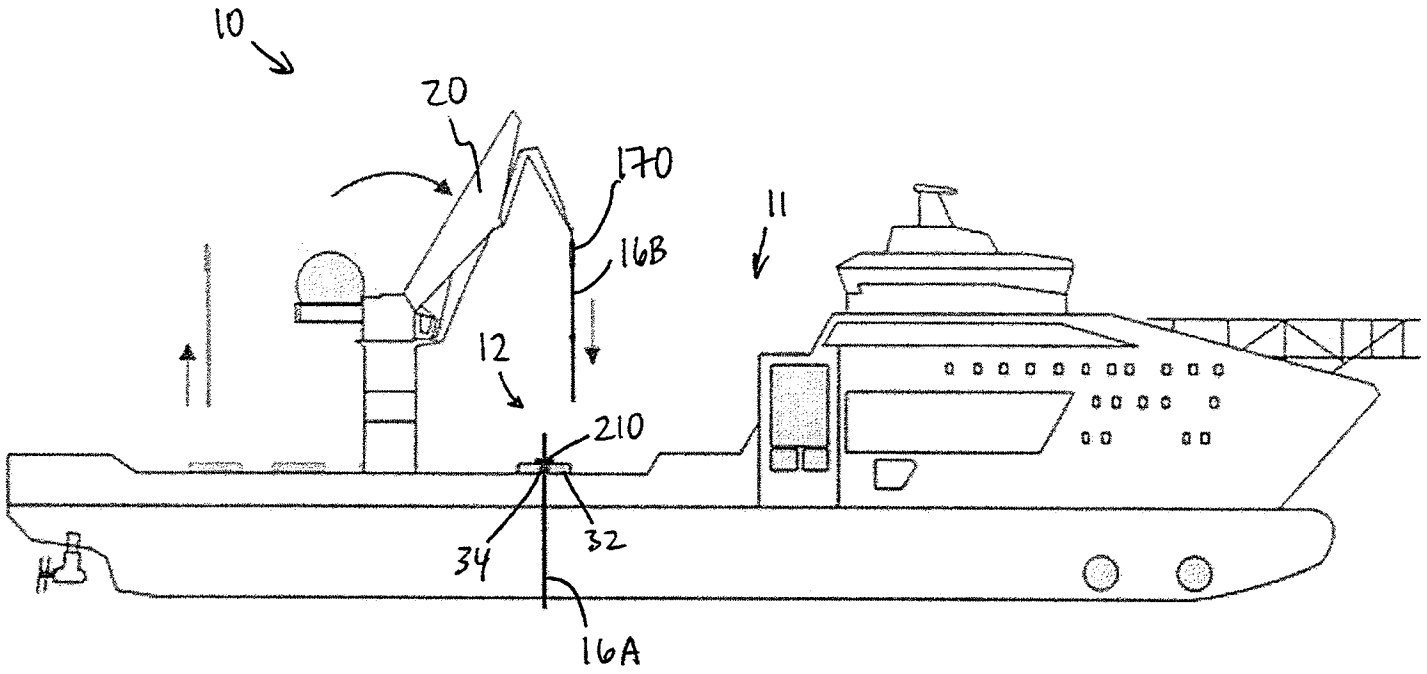

It should be noted that FIGS. 7-12 only represent one series of steps that may be used to construct the intervention system 12 to be deployed to a subsea well. Other types of intervention systems 12 including at least a downhole tool string 16 may be constructed using the disclosed deployment system as well. For example, FIGS. 13-14 illustrate a process for constructing an intervention system 12 that includes just a tool string 16 without any subsea modules coupled thereto. Using the protruding section 32 with the mouse hole 34 may enable the system to deploy a tool string 16 over the side 30 of the vessel 11 and through the water column when the overall length of the assembled tool string 16 surpasses the lifting capability of the vessel crane 20.

During construction of the tool string 16, the mouse hole 34 through the protruding section 32 may be used as a hang-off point for connecting the tool string components 16A and 16B. For example, the mouse hole 34 may be equipped with a hang-off device 210 used to support and/or connect the tool string components. The hang-off device 210 may include a conventional hang-off plate (or C-plate) similar to the hang-off plate 150 described with reference to FIG. 9, or the hang-off device 210 may include a set of slips. The hang-off device 210 may include a spider disposed on the protruding section and used to automatically couple an upper end of the tool string component in the mouse hole 34 to a lower end of the next tool string component to be connected. In addition to the hang-off device 210 (e.g., hang-off plate, slips, or spider), the system may include a gimbal installed on the mouse hole 34 to provide a certain pitch/roll/yaw freedom of movement for the tool string in response to vessel motions.

The multiple tubular components (e.g., 16A and 16B) that make up the tool string 16 may be individually lifted up by the vessel crane 20 and hung off piece by piece from the hang-off device 210 (e.g., hang-off plate, slips, or spider). For example, a lower section 16A may be picked up by the vessel crane 20 and positioned over the mouse hole 34 on the protruding section 32, as shown in FIG. 13. The crane 20 may lower the tool section 16A through the mouse hole 34, and before the upper end of the section 16A passes through the protruding section 32, the hang-off device 210 may be installed or actuated on the protruding section to hold the lower section 16A in place. In embodiments where a spider, slips, and/or gimbal are attached to the protruding section 32, the lower section 16A may be picked up by the vessel crane 20, positioned over the mouse hole 34, and lowered through the mouse hole 34, the spider, slips, and/or gimbal. Before the upper end of the section 16A passes through the protruding section, the spider or slips may be actuated closed around the lower section 16A to hold the lower section 16A in place.

The crane 20 then disconnects from the lower section 16A and retrieves the upper section 16B, as shown in FIG. 14. The crane 20 may position the upper section directly above the lower section 16A, and the upper and lower sections 16B and 16A may be made up with suitable tooling equipment (e.g., manually operated tooling or the spider) while the vessel crane 20 (and possibly tugger wires on the vessel 11) holds the upper section 16B in place. The assembled tool 16 may be lifted slightly to remove loads from the hang-off device 210 before the device 210 is removed, or the hang-off device 210 may be actuated open to release the tool 16, which is supported by the crane 20. Once the hang-off device 210 is removed or actuated open, the tool string 16 may be supported entirely by the vessel crane 20. From here, the process of FIGS. 13-14 may be repeated to add additional lengths of tool components to the tool string 16 until the tool string 16 is fully assembled.

Figure 15:
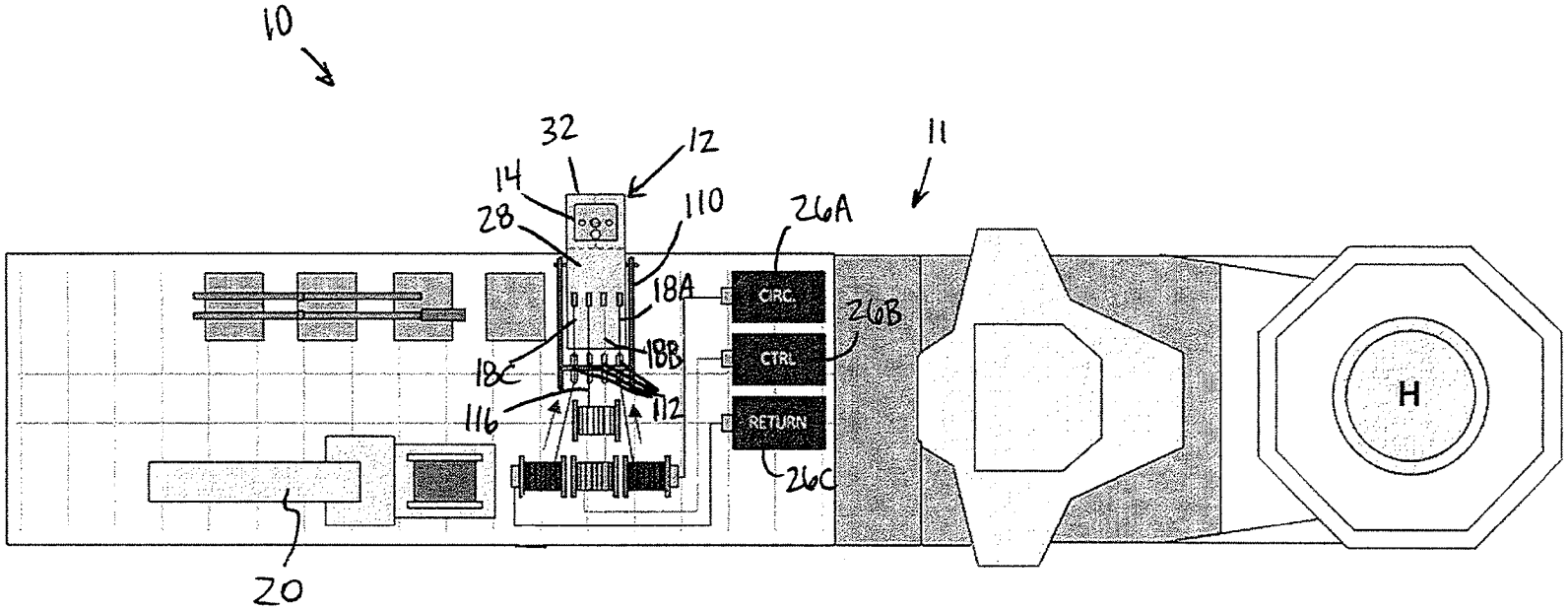
FIGS. 15, 16, 17 are schematic top and side cutaway views of the multi-purpose vessel of FIG. 1 using the sheave frame of FIGS. 5A-5C to connect a deployment cable/downlines to the intervention system, in accordance with an embodiment of the present disclosure.
Figure 16:
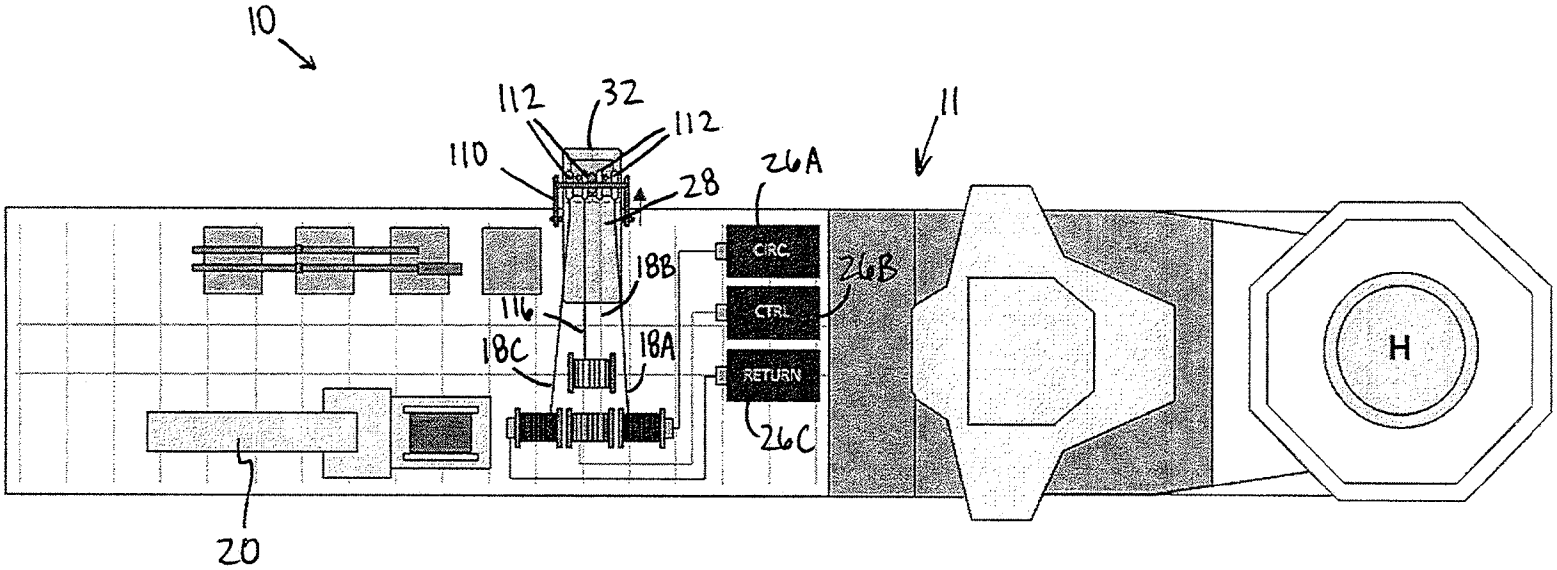
Figure 17:
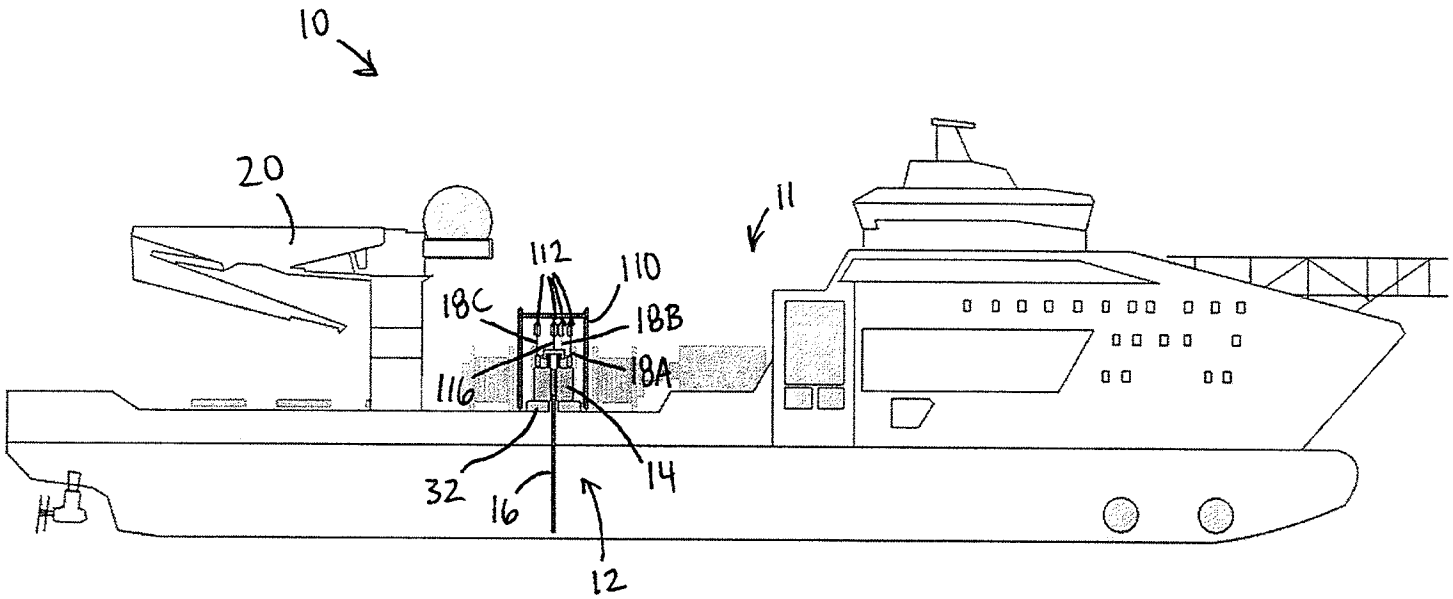

After the intervention system 12 (which may include the tool string 16 with or without the subsea module 14) is fully constructed, it may be desirable to connect one or more downlines 18, umbilicals, and/or a deployment cable 116 to the intervention system 12. This process is illustrated in FIGS. 15-17. Although the illustrated intervention system 12 includes the downhole tool string 16 landed in and supported by the subsea module 14, the same method may be utilized for connecting various auxiliary lines to just the tool string 16 if a subsea module is not used. The subsea module 14 and/or tool string 16 may be equipped with suitable connection points to interface with the end terminations on the downlines 18. Each of the downlines 18 (e.g., 18A, 18B, and 18C) may be routed through the sheaves 112 mounted in the sheave frame 110, as shown in FIG. 15. In other embodiments, the sheaves 112 may be disassembled from the sheave frame 110 to allow for simpler assembly of the end terminations on the various downlines 18. With the sheaves 112 assembled in the sheave frame 110, the fame 110 may then be pivoted from the retracted position of FIG. 15 to the extended position of FIG. 16 to align the exit points of each sheave 112 with the connection points on the subsea module 14 (and/or tool string 16). The downlines 18 and deployment cable 116 may then be connected to a top surface of the intervention system 12 (e.g., subsea module 14 and/or tool string 16).

FIG. 17 shows a side view of the sheave frame 110 in the extended mode above the intervention system 12. The deployment cable 116 may come from a compensated winch with the cable 116 routed through a sheave 112 in the sheave frame 110. As illustrated, the sheave 112 with the cable 116 routed therethrough may be aligned directly above the centerline and bore 36 of the subsea module 14, so that the intervention system 12 may be lowered smoothly via the deployment cable 116. The deployment cable 116 may be aligned with the downhole tool string 16, the mouse hole 34, and the hub of the subsea module 14. In other embodiments, a cable associated with the vessel crane 20 (and not routed through the sheave frame 110) may be connected to the top of the intervention system 12 and used to deploy the system 12.

Once supported by the deployment cable 116 or vessel crane 20, the intervention system 12 may be lifted up from the protruding section 32 to remove loads on the deployment frame 28. In instances where the intervention system 12 includes just a tool string 16, this may involve lifting the tool string 16 via the deployment cable 116 (or crane 20) and removing or actuating open the hang-off device (e.g., 210 of FIG. 14). In instances where the intervention system 12 includes both the tubing string 16 and the subsea module 14, the guiding system (e.g., 38 of FIG. 1) may keep the subsea module 14 in place relative to the side 30 of the vessel 11 during this lift. In order to provide a deployment path for the tool string 16 and/or the subsea module 14, the protruding section 32 of the deployment frame 28 may be split in half as shown in FIG. 18. This may involve rotating two opposing halves 32A and 32B of the protruding section 32 in opposite directions away from each other and into contact with the side 30 of the vessel 11. In other embodiments, the protruding section 32 may be collapsed upwards or downwards (e.g., FIG. 6) or retracted out of the way (e.g., FIG. 4). This moves the protruding section 32 out of a deployment path of the intervention system 12. As this point, the system 12 is ready for deployment.

Figure 19:
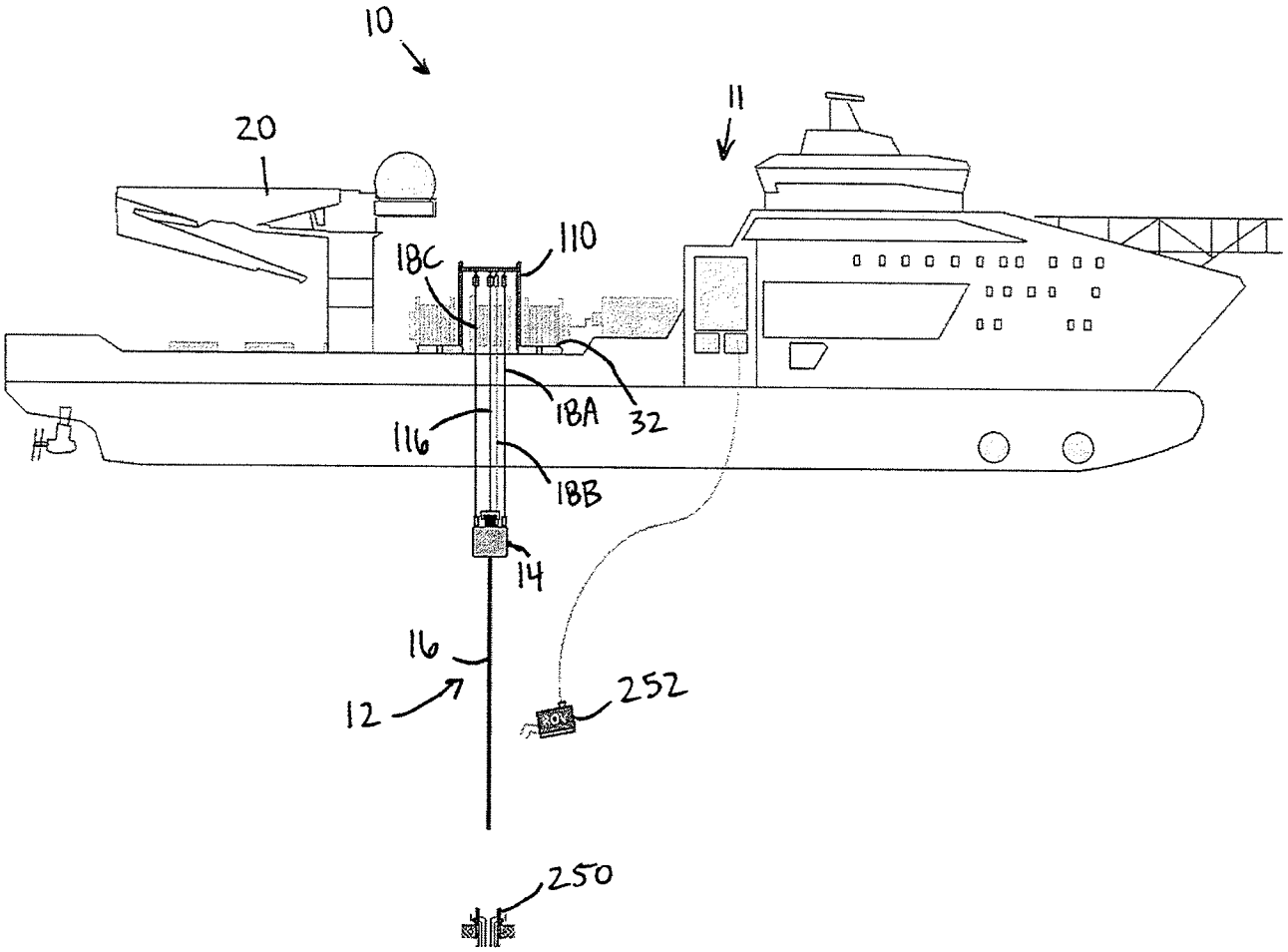
FIGS. 19, 20, 21 are schematic side views of the intervention system of FIG. 1 being deployed from the multi-purpose vessel and connected to a subsea wellhead, in accordance with an embodiment of the present disclosure.

The complete assembly including the intervention system 12 and any connected downlines 18 or umbilicals may then be deployed through the splash zone and water column from the side of the vessel 11 in a single trip, as shown in FIG. 19. The deployment cable 116 may provide a controlled descent of the intervention system 12 toward a subsea wellhead 250 located at the seabed. A remote operated vehicle (ROV) 252 may assist during the deployment process to help guide and/or attach the intervention system 12 to the subsea wellhead 250.

Figure 20:
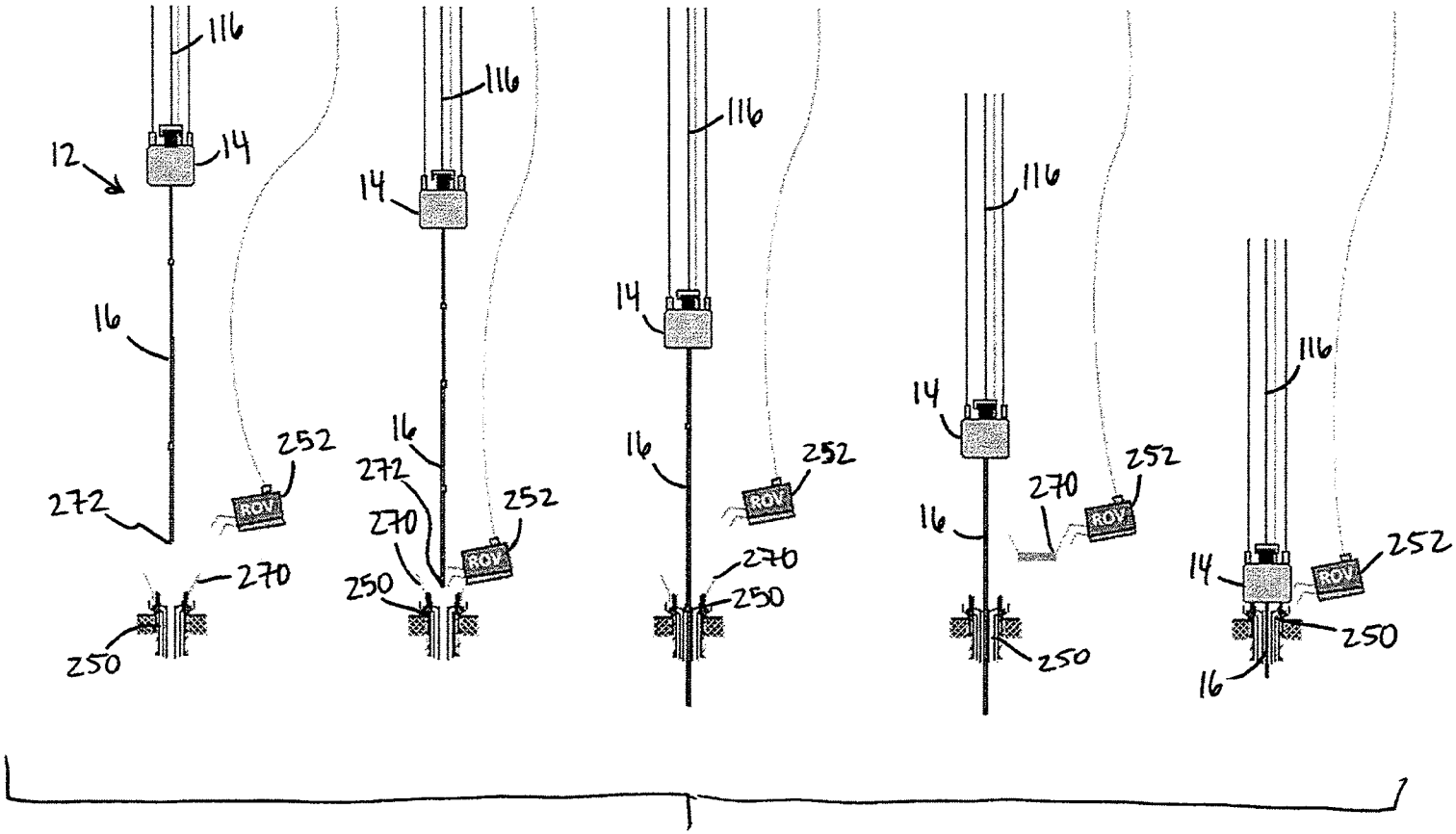

FIG. 20 illustrates the ROV 252 installing the intervention system 12 within the subsea wellhead 250 as the intervention system 12 is being lowered. Prior to deployment of the intervention system 12, the ROV 252 may install a separable funnel 270 on the wellhead 250. When the tool string 16 of the intervention system 12 approaches the wellhead 250, the ROV 252 may guide the lower tip 272 of the tool string 16 inside the main bore of the wellhead 250 and inside an innermost casing hanger. The funnel 270 may help to guide the lower tip 272 of the tool string 16 into the wellhead 250 as well. The subsea module 14 may be continuously lowered towards the wellhead 250, and the compensation system on a topside winch (e.g., 24) or vessel crane (e.g., 20) may allow for a controllable descent during the landing sequence. The separable funnel 270 may be removed by the ROV 252 before the subsea module 14 approaches the wellhead 250, and the subsea module 14 may land on the wellhead 250. The wellhead connector of the subsea module 14 may be locked by the ROV 252 or remotely through a control system (e.g., 26B) communicating to the subsea module through one of the downlines. When the connector is locked, the deployment cable 116 may be released from the subsea module 14 (or tool string 16) and retrieved to the surface. Although FIG. 20 illustrates the ROV 252 guiding the intervention system 12 to land directly into the subsea wellhead 250, the ROV 252 may be similarly used to guide the intervention system 12 into a subsea tree coupled to the subsea wellhead 250 or into another intervention system that has previously been installed on the subsea wellhead 250 or subsea tree.

Figure 21:
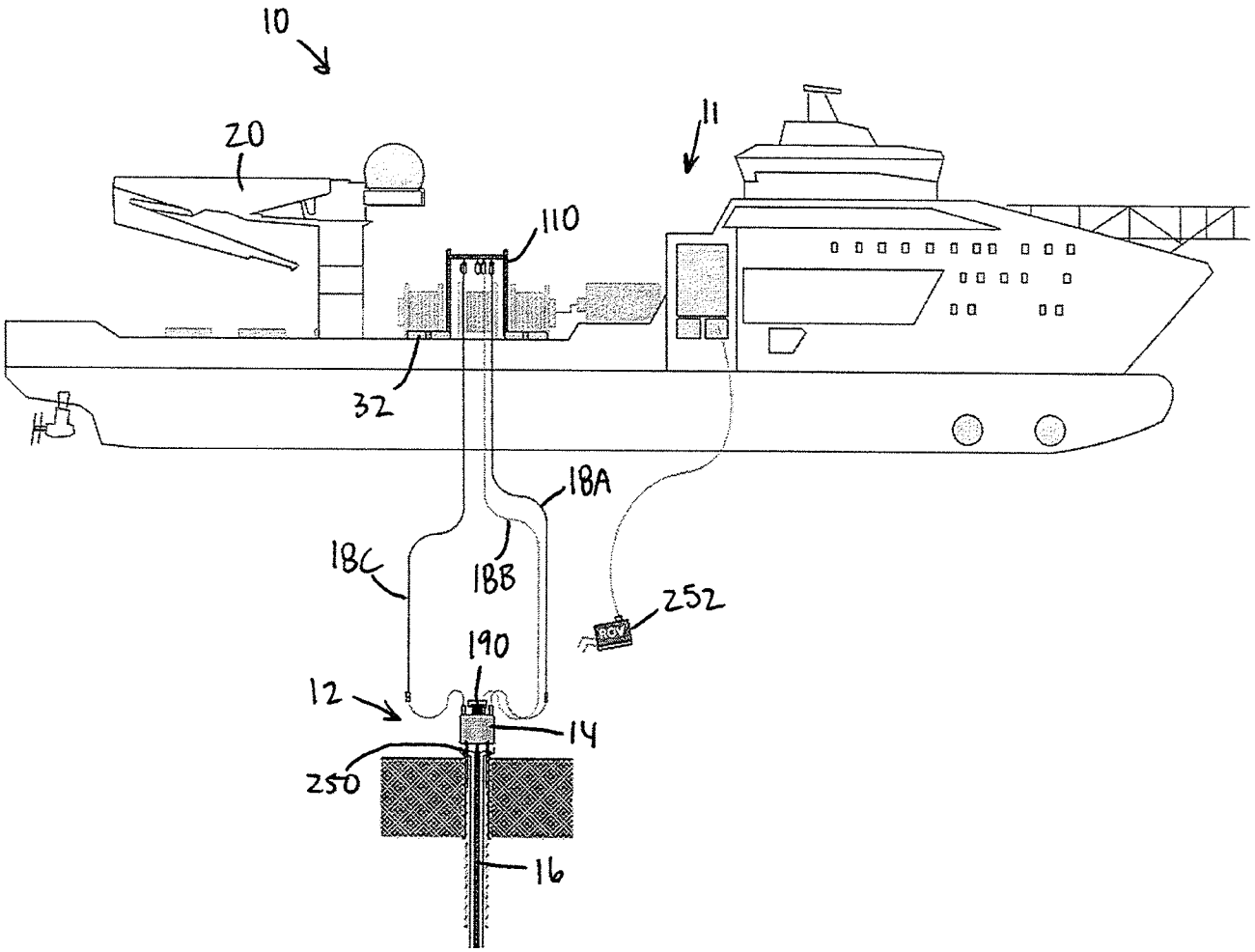

FIG. 21 illustrates the intervention system 12 installed in the subsea wellhead 250 with all downlines 18 running to the intervention system 12. The deployment tool 190 may stay connected to the re-entry mandrel of the subsea module 14 during operation of the intervention system 12 to provide debris protection and to avoid having to deploy the tool 190 again when the system 12 is ready to be pulled to the surface.

The deployment method described above with reference to FIGS. 7-21 may be reversible to enable efficient retrieval of the intervention system 12 to the surface. For example, when the in-well operation is finished, the wellhead connector on the subsea module 14 may be unlocked using the ROV 252 or remotely using the control system 26B. The deployment cable 116 may be connected to the deployment tool 190, and the intervention system 12 may be pulled to the surface in a single trip. The subsea module 14 may be lifted along the side 30 of the vessel 11 to a height where the protruding section 32 of the deployment frame 28 can be re-extended back to a position under the subsea module 14 to facilitate a safe landing. At this point, the downlines 18 may be disconnected from the module 14 along with the deployment tool 190. The vessel crane 20 may lift the tool hanger 170 up from the subsea module 14 and hang off the tool string 16 at the same location as during installation via a hang-off plate 150. The tool string 16 may then be disconnected to enable removal of the upper section 16B of the tool 16. The vessel crane 20 may individually pick up any intermediate sections of the tool string 16 as they are disconnected and eventually the lower section 16A hanging from the hang-off plate 150 to remove it from the subsea module 14. The hang-off plate 150 may be removed and the subsea module 14 may be lifted to a suitable location on the deck 22 or skidded inward on the deployment frame 28. Lastly, the protruding frame 28 may be retracted so that the protruding section is located entirely on the deck 22 of the vessel 11.

Other methods may be used to retrieve the intervention system 12 in a single trip. For example, when the intervention system 12 only include a tool string 16, the method may involve pulling the tool string 16 to the surface, extending the protruding section 32 of the deployment frame 28 back into position around the tool string 16, and installing or actuating the hang-off device 210 on the mouse hole 34 of the protruding section 28 to support the tool string 16 while the deployment cable 116 and downlines 18 are disconnected. The tool string 16 may be disconnected (via manually operated tool or a spider) to enable removal of the upper section 16B of the tool string 16. The vessel crane 20 may individually pick up any intermediate sections of the tool string 16 as they are disconnected and eventually the lower section 16A hanging from the hang-off device 210.

Although the method described above involves coupling the downlines 18 to the intervention system 12 (e.g., tool string 16 and/or subsea module 14) at the surface and then deploying the system with the downlines 18 to the wellhead 250 in a single trip, other methods may involve deploying the downlines 18 separately from the intervention system 12. By furnishing the downlines 18 and the subsea module 14 (or tool string 16) with wet mateable connections, the downlines 18 may be deployed at a later stage and connected/disconnected subsea. This may be particularly useful when deploying the intervention system 12 in deeper waters, as the separate deployment of the downlines 18 helps to avoid entanglement of the downlines 18 prior to connection of the intervention system 12 to the wellhead 250. The disclosed deployment system therefore provides increased flexibility for how and where downlines (and/or umbilicals) can be connected to the intervention system 12.

The disclosed deployment system 10 and method may enable an intervention system 12 including at least a downhole tool string 16 to be deployed in a single trip, which decreases the overall operational time to provide a subsea well intervention. The system may be pulled in a single trip as well. Using the above described deployment method may allow an operator to deploy longer tool strings 16 without the need for a moon pool and derrick, as the tool strings 16 may be constructed over the side of the vessel 11 using the protruding section 32 with the mouse hole 34 and a standard vessel crane 20. The intervention system 12 may be deployed from a MIN 11 without a moon pool, which greatly increases the types of vessels 11 that can be used to deploy such a system 12. This may provide larger flexibility for the end user with regard to which vessel 11 is used to deploy the intervention system, as well as lower day rates when vessels 11 without a moon pool are used. When the intervention system 12 includes a subsea module 14, the disclosed deployment system 10 may enable connections between the tool string 16 and the subsea module 14 to be made topside (e.g., on the protruding section 32). This allows operators to visually inspect that everything is connected properly, and change-out of equipment may be performed swiftly in the event of a malfunctioning piece of equipment.

In an embodiment, the well equipment is a well completion. The well completion may comprise an elongate tubular built from sections of tubular components, for installation into the well. The tubular can thus be built through the mouse hole aperture 34 on the protruding section 32, equivalently as described above, and then lowered down and installed in the well. The well completion may also comprise a module, such as a valve tree. The valve tree may be connected to the tubular at its top end, and lowered down for installation in the well and on the wellhead. Advantageously, this allows a well completion to be built and installed in a single run, for example from a multi-purpose vessel.

Although the present disclosure and its advantages have been described in detail, it should be understood that various changes, substitutions and alterations can be made herein without departing from the spirit and scope of the disclosure as defined by the following claims.

What is claimed is:

1. A system for deploying well equipment to a subsea well, comprising:

a vessel;

a deployment frame disposed on the vessel, wherein the deployment frame comprises a protruding section extending as a cantilever beyond an external edge of the vessel;

wherein the protruding section comprises an aperture formed therein to facilitate construction of the well equipment through the protruding section while the well equipment is supported over the external edge of the vessel via the protruding section;

an actuation assembly coupled to the protruding section to selectively transition the protruding section to a collapsed, split, or retracted orientation out of a deployment path of the well equipment while the well equipment is suspended through the protruding section and/or in the deployment path; and a sheave frame disposed on the vessel, wherein the sheave frame is selectively extendable from a retracted position within the external edge of the vessel to an extended position directly over the protruding section.

2. The system according to claim 1, further comprising a deployment cable extending from a reel on the vessel and through a sheave on the sheave frame for connecting to the well equipment.

3. The system according to claim 1, further comprising a control, communication, or fluid downline extending from a reel on the vessel and through a sheave on the sheave frame for connecting to the well equipment.

4. The system according to claim 1, wherein the protruding section comprises guide features configured to interface with complementary guide features on a subsea module of the well equipment.

5. The system according to claim 1, wherein the deployment frame comprises a skidding system disposed thereon to facilitate movement of a subsea module of the well equipment onto the protruding section.

6. The system according to claim 1, wherein the protruding section is selectively retractable to a position that is not extending beyond the external edge of the vessel.

7. The system according to claim 1, wherein the protruding section comprises a hang-off device configured for vertically supporting a tubular component of the well equipment suspended through the aperture.

8. The system of claim 7, wherein the hang-off device is configured to engage an outer surface of the tubular component to support the tubular component.

9. The system of claim 7, wherein the hang-off device is selectively activable to engage the tubular component.

10. A system for deploying well equipment to a subsea well, comprising:

a vessel;

a deployment frame disposed on the vessel, wherein the deployment frame comprises a protruding section extending as a cantilever beyond an external edge of the vessel;

wherein the protruding section comprises an aperture formed therein to facilitate construction of the well equipment through the protruding section; and an actuation assembly coupled to the protruding section to selectively transition the protruding section to a collapsed, split, or retracted orientation out of a deployment path of the well equipment while the well equipment is suspended through the protruding section and/or in the deployment path;

wherein the protruding section comprises two separate halves disposed adjacent each other and the actuation assembly comprises a latching mechanism that, when activated, enables the two halves to rotate away from each other and in opposite directions away from the deployment path.

11. A system for deploying well equipment to a subsea well, comprising:

a vessel;

a deployment frame disposed on the vessel, wherein the deployment frame comprises a protruding section extending as a cantilever beyond an external edge of the vessel;

wherein the protruding section comprises an aperture formed therein to facilitate construction of the well equipment through the protruding section while the well equipment is supported over the external edge of the vessel via the protruding section; and an actuation assembly coupled to the protruding section to selectively transition the protruding section to a collapsed, split, or retracted orientation out of a deployment path of the well equipment while the well equipment is suspended through the protruding section and/or in the deployment path;

wherein the protruding section comprises a slot extending from the aperture to an external edge of the protruding section.

12. A system for deploying well equipment to a subsea well, comprising:

a vessel;

a deployment frame disposed on the vessel, wherein the deployment frame comprises a protruding section extending as a cantilever beyond an external edge of the vessel;

wherein the protruding section comprises an aperture formed therein to facilitate construction of the well equipment through the protruding section while the well equipment is supported over the external edge of the vessel via the protruding section; and an actuation assembly coupled to the protruding section to selectively transition the protruding section to a collapsed, split, or retracted orientation out of a deployment path of the well equipment;

wherein the actuation assembly is operable to transition the protruding section while the well equipment is suspended through the protruding section and/or in the deployment path.

13. A method, comprising:

constructing a well equipment system comprising at least a downhole tubular or tool string over an external edge of a vessel, wherein the well equipment system is supported over the external edge via a protruding section of a deployment frame disposed on the vessel, wherein the protruding section comprises an aperture through which at least a portion of the well equipment system is disposed;

suspending the well equipment system from a deployment cable;

splitting, retracting, or collapsing the protruding section of the deployment frame out of a path of the well equipment system while the well equipment is suspended through the protruding section and/or in the deployment path; and with the frame out of the path, lowering the well equipment system toward a subsea wellhead in a single trip.

14. The method according to claim 13, further comprising connecting a control, communication, or fluid downline to the well equipment system, and lowering the well equipment system and the downline in a single trip.

15. The method according to claim 13, further comprising:

retrieving the well equipment system from the subsea wellhead;

actuating the protruding section back to a position such that at least a portion of the well equipment system is disposed through the aperture; and deconstructing the well equipment system supported by the protruding section.

16. The method according to claim 13 wherein constructing the well equipment system comprises disposing a first tubular component through the aperture of the protruding section, supporting the first tubular component on the protruding section via a hang-off device, and connecting a second tubular component to the first tubular component to form the downhole tubular or tool string.

17. The method according to claim 13, wherein the well equipment system further comprises a subsea module with an internal bore, wherein constructing the well equipment system comprises disposing the subsea module on the protruding section of the deployment frame and constructing the downhole tubular or tool string through the internal bore of the subsea module.

18. The method according to claim 17, further comprising collapsing the protruding section downward against a side of the vessel, and guiding the subsea module downward via a support structure disposed on the protruding section.

19. The method according to claim 13, further comprising extending the deployment cable from a reel to a sheave frame, actuating the sheave frame from a retracted position to an extended position above the protruding section, and coupling the deployment cable to the well equipment system.

20. The method according to claim 13, further comprising extending the deployment cable from a crane disposed on the vessel and coupling the deployment cable to the well equipment system.

21. The method according to claim 13, further comprising guiding the well equipment system into the subsea wellhead, a subsea tree coupled to the subsea wellhead, or an intervention system already installed in the subsea wellhead or subsea tree, using a remote operated vehicle (ROV).

* * * * *